US011600227B2

(12) United States Patent
Tsai

(10) Patent No.: US 11,600,227 B2
(45) Date of Patent: *Mar. 7, 2023

(54) CIRCUIT AND METHOD FOR DRIVING LIGHT SOURCES

(71) Applicant: Novatek Microelectronics Corp., Hsinchu (TW)

(72) Inventor: Wen-Pin Tsai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/542,472

(22) Filed: Dec. 5, 2021

(65) Prior Publication Data

US 2022/0093044 A1 Mar. 24, 2022

Related U.S. Application Data

(63) Continuation of application No. 16/727,943, filed on Dec. 27, 2019, now Pat. No. 11,195,458.

(60) Provisional application No. 62/785,228, filed on Dec. 27, 2018.

(51) Int. Cl.
*G09G 3/3233* (2016.01)
*G09G 3/20* (2006.01)

(52) U.S. Cl.
CPC ..... *G09G 3/3233* (2013.01); *G09G 3/2003* (2013.01); *G09G 2310/027* (2013.01); *G09G 2310/0297* (2013.01); *G09G 2320/0252* (2013.01)

(58) Field of Classification Search
CPC .. G09G 3/3233; G09G 3/3413; G09G 3/3426; H05B 45/00; H05B 33/08
See application file for complete search history.

(56) References Cited

U.S. PATENT DOCUMENTS

| | | | |
|---|---|---|---|
| 8,188,994 | B2 | 5/2012 | Tada et al. |
| 8,284,185 | B1 | 10/2012 | Tada et al. |
| 8,384,626 | B2 | 2/2013 | Yamamoto et al. |
| 8,514,216 | B2 | 8/2013 | Tada et al. |
| 8,982,018 | B2 | 3/2015 | Yamamoto et al. |
| 9,275,576 | B2 | 3/2016 | Tada et al. |
| 2008/0018640 | A1 | 1/2008 | Tada et al. |
| 2009/0219234 | A1 | 9/2009 | Yamamoto et al. |
| 2012/0235980 | A1 | 9/2012 | Tada et al. |

(Continued)

FOREIGN PATENT DOCUMENTS

| | | |
|---|---|---|
| TW | 200826042 | 6/2008 |
| TW | 200949800 | 12/2009 |

OTHER PUBLICATIONS

"Notice of Allowance of China Counterpart Application", dated Jan. 26, 2022, p. 1-p. 4.

*Primary Examiner* — Sardis F Azongha
(74) *Attorney, Agent, or Firm* — JCIPRNET

(57) ABSTRACT

A driving circuit that includes a plurality of sub-driving circuits and a plurality of first switching circuits is introduced. The sub-driving circuits is configured to supply a plurality of driving currents to drive a first group of light sources to emit light to form a first pixel on a display medium. The first switching circuits are respectively coupled to the sub-driving circuits and are configured to control the plurality of sub-driving circuits to supply the driving currents to the first group of light sources according to the pixel data, wherein a current value of each of the plurality of driving currents is corresponding to a bit order of a respective bit of the pixel data.

19 Claims, 16 Drawing Sheets

(56) References Cited

U.S. PATENT DOCUMENTS

| | | | |
|---|---|---|---|
| 2012/0320110 | A1 | 12/2012 | Tada et al. |
| 2013/0127370 | A1 | 5/2013 | Yamamoto et al. |
| 2013/0300782 | A1 | 11/2013 | Tada et al. |

T

| | T1 | T2 | T3 | T4 | T5 | T6 | T7 | T8 | T9 | T10 | T11 | T12 | T13 | T14 | T15 | T16 | T17 | T18 | T19 | T20 |
|---|---|---|---|---|---|---|---|---|---|---|---|---|---|---|---|---|---|---|---|---|
| ROW_1 | P1 B[0] | P2 B[0] | P3 B[0] | P4 B[0] | P5 B[0] | P6 B[0] | P7 B[0] | P8 B[0] | P9 B[0] | P10 B[0] | P11 B[0] | P12 B[0] | P13 B[0] | P14 B[0] | P15 B[0] | P16 B[0] | P17 B[0] | P18 B[0] | P19 B[0] | P20 B[0] |
| ROW_2 | OFF | P1 B[1] | P2 B[1] | P3 B[1] | P4 B[1] | P5 B[1] | P6 B[1] | P7 B[1] | P8 B[1] | P9 B[1] | P10 B[1] | P11 B[1] | P12 B[1] | P13 B[1] | P14 B[1] | P15 B[1] | P16 B[1] | P17 B[1] | P18 B[1] | P19 B[1] |
| ROW_3 | OFF | OFF | P1 B[2] | P2 B[2] | P3 B[2] | P4 B[2] | P5 B[2] | P6 B[2] | P7 B[2] | P8 B[2] | P9 B[2] | P10 B[2] | P11 B[2] | P12 B[2] | P13 B[2] | P14 B[2] | P15 B[2] | P16 B[2] | P17 B[2] | P18 B[2] |
| ROW_4 | OFF | OFF | OFF | P1 B[3] | P2 B[3] | P3 B[3] | P4 B[3] | P5 B[3] | P6 B[3] | P7 B[3] | P8 B[3] | P9 B[3] | P10 B[3] | P11 B[3] | P12 B[3] | P13 B[3] | P14 B[3] | P15 B[3] | P16 B[3] | P17 B[3] |
| ROW_5 | OFF | OFF | OFF | OFF | P1 B[4] | P2 B[4] | P3 B[4] | P4 B[4] | P5 B[4] | P6 B[4] | P7 B[4] | P8 B[4] | P9 B[4] | P10 B[4] | P11 B[4] | P12 B[4] | P13 B[4] | P14 B[4] | P15 B[4] | P16 B[4] |
| ROW_6 | OFF | OFF | OFF | OFF | OFF | P1 B[5] | P2 B[5] | P3 B[5] | P4 B[5] | P5 B[5] | P6 B[5] | P7 B[5] | P8 B[5] | P9 B[5] | P10 B[5] | P11 B[5] | P12 B[5] | P13 B[5] | P14 B[5] | P15 B[5] |
| ROW_7 | OFF | OFF | OFF | OFF | OFF | OFF | P1 B[6] | P2 B[6] | P3 B[6] | P4 B[6] | P5 B[6] | P6 B[6] | P7 B[6] | P8 B[6] | P9 B[6] | P10 B[6] | P11 B[6] | P12 B[6] | P13 B[6] | P14 B[6] |
| ROW_8 | OFF | OFF | OFF | OFF | OFF | OFF | OFF | P1 B[7] | P2 B[7] | P3 B[7] | P4 B[7] | P5 B[7] | P6 B[7] | P7 B[7] | P8 B[7] | P9 B[7] | P10 B[7] | P11 B[7] | P12 B[7] | P13 B[7] |

FIG. 2C

T

| | T1 | T2 | T3 | T4 | T5 | T6 | T7 | T8 | T9 | T10 | T11 | T12 | T13 | T14 | T15 | T16 | T17 | T18 | T19 | T20 |
|---|---|---|---|---|---|---|---|---|---|---|---|---|---|---|---|---|---|---|---|---|
| ROW_1 | P1 B[0] | P2 B[0] | P3 B[0] | P4 B[0] | P5 B[0] | P6 B[0] | P7 B[0] | P8 B[0] | P9 B[0] | P10 B[0] | P11 B[0] | P12 B[0] | P13 B[0] | P14 B[0] | P15 B[0] | P16 B[0] | P17 B[0] | P18 B[0] | P19 B[0] | P20 B[0] |
| ROW_2 | OFF | OFF | P1 B[1] | P2 B[1] | P3 B[1] | P4 B[1] | P5 B[1] | P6 B[1] | P7 B[1] | P8 B[1] | P9 B[1] | P10 B[1] | P11 B[1] | P12 B[1] | P13 B[1] | P14 B[1] | P15 B[1] | P16 B[1] | P17 B[1] | P18 B[1] |
| ROW_3 | OFF | OFF | OFF | OFF | P1 B[2] | P2 B[2] | P3 B[2] | P4 B[2] | P5 B[2] | P6 B[2] | P7 B[2] | P8 B[2] | P9 B[2] | P10 B[2] | P11 B[2] | P12 B[2] | P13 B[2] | P14 B[2] | P15 B[2] | P16 B[2] |
| ROW_4 | OFF | OFF | OFF | OFF | OFF | OFF | P1 B[3] | P2 B[3] | P3 B[3] | P4 B[3] | P5 B[3] | P6 B[3] | P7 B[3] | P8 B[3] | P9 B[3] | P10 B[3] | P11 B[3] | P12 B[3] | P13 B[3] | P14 B[3] |
| ROW_5 | OFF | OFF | OFF | OFF | OFF | OFF | OFF | OFF | P1 B[4] | P2 B[4] | P3 B[4] | P4 B[4] | P5 B[4] | P6 B[4] | P7 B[4] | P8 B[4] | P9 B[4] | P10 B[4] | P11 B[4] | P12 B[4] |
| ROW_6 | OFF | OFF | OFF | OFF | OFF | OFF | OFF | OFF | OFF | OFF | P1 B[5] | P2 B[5] | P3 B[5] | P4 B[5] | P5 B[5] | P6 B[5] | P7 B[5] | P8 B[5] | P9 B[5] | P10 B[5] |
| ROW_7 | OFF | OFF | OFF | OFF | OFF | OFF | OFF | OFF | OFF | OFF | OFF | OFF | P1 B[6] | P2 B[6] | P3 B[6] | P4 B[6] | P5 B[6] | P6 B[6] | P7 B[6] | P8 B[6] |
| ROW_8 | OFF | OFF | OFF | OFF | OFF | OFF | OFF | OFF | OFF | OFF | OFF | OFF | OFF | OFF | P1 B[7] | P2 B[7] | P3 B[7] | P4 B[7] | P5 B[7] | P6 B[7] |

FIG. 2D

T

| | T1 | T2 | T3 | T4 | T5 | T6 | T7 | T8 | T9 | T10 | T11 | T12 | T13 | T14 | T15 | T16 | T17 | T18 | T19 | T20 |
|---|---|---|---|---|---|---|---|---|---|---|---|---|---|---|---|---|---|---|---|---|
| ROW_1 | P1 B[0] +[B1] +[B2] | P2 B[0] +[B1] +[B2] | P3 B[0] +[B1] +[B2] | P4 B[0] +[B1] +[B2] | P5 B[0] +[B1] +[B2] | P6 B[0] +[B1] +[B2] | P7 B[0] +[B1] +[B2] | P8 B[0] +[B1] +[B2] | P9 B[0] +[B1] +[B2] | P10 B[0] +[B1] +[B2] | P11 B[0] +[B1] +[B2] | P12 B[0] +[B1] +[B2] | P13 B[0] +[B1] +[B2] | P14 B[0] +[B1] +[B2] | P15 B[0] +[B1] +[B2] | P16 B[0] +[B1] +[B2] | P17 B[0] +[B1] +[B2] | P18 B[0] +[B1] +[B2] | P19 B[0] +[B1] +[B2] | P20 B[0] +[B1] +[B2] |
| ROW_2 | OFF | OFF | P1 B[3] | P2 B[3] | P3 B[3] | P4 B[3] | P5 B[3] | P6 B[3] | P7 B[3] | P8 B[3] | P9 B[3] | P10 B[3] | P11 B[3] | P12 B[3] | P13 B[3] | P14 B[3] | P15 B[3] | P16 B[3] | P17 B[3] | P18 B[3] |
| ROW_3 | OFF | OFF | OFF | OFF | P1 B[4] | P2 B[4] | P3 B[4] | P4 B[4] | P5 B[4] | P6 B[4] | P7 B[4] | P8 B[4] | P9 B[4] | P10 B[4] | P11 B[4] | P12 B[4] | P13 B[4] | P14 B[4] | P15 B[4] | P16 B[4] |
| ROW_4 | OFF | OFF | OFF | OFF | OFF | OFF | P1 B[5] | P2 B[5] | P3 B[5] | P4 B[5] | P5 B[5] | P6 B[5] | P7 B[5] | P8 B[5] | P9 B[5] | P10 B[5] | P11 B[5] | P12 B[5] | P13 B[5] | P14 B[5] |
| ROW_5 | OFF | OFF | OFF | OFF | OFF | OFF | OFF | OFF | P1 B[6] | P2 B[6] | P3 B[6] | P4 B[6] | P5 B[6] | P6 B[6] | P7 B[6] | P8 B[6] | P9 B[6] | P10 B[6] | P11 B[6] | P12 B[6] |
| ROW_6 | OFF | OFF | OFF | OFF | OFF | OFF | OFF | OFF | OFF | OFF | P1 B[7] | P2 B[7] | P3 B[7] | P4 B[7] | P5 B[7] | P6 B[7] | P7 B[7] | P8 B[7] | P9 B[7] | P10 B[7] |
| ROW_7 | OFF | OFF | OFF | OFF | OFF | OFF | OFF | OFF | OFF | OFF | OFF | OFF | P1 B[8] | P2 B[8] | P3 B[8] | P4 B[8] | P5 B[8] | P6 B[8] | P7 B[8] | P8 B[8] |
| ROW_8 | OFF | OFF | OFF | OFF | OFF | OFF | OFF | OFF | OFF | OFF | OFF | OFF | OFF | OFF | P1 B[9] | P2 B[9] | P3 B[9] | P4 B[9] | P5 B[9] | P6 B[9] |

FIG. 3B

T

| | T1 | T2 | T3 | T4 | T5 | T6 | T7 | T8 | T9 | T10 | T11 | T12 | T13 | T14 | T15 | T16 | T17 | T18 | T19 | T20 |
|---|---|---|---|---|---|---|---|---|---|---|---|---|---|---|---|---|---|---|---|---|
| ROW_1 | P1 B[0] | P2 B[0] | P3 B[0] | P4 B[0] | P5 B[0] | P6 B[0] | P7 B[0] | P8 B[0] | P9 B[0] | P10 B[0] | P11 B[0] | P12 B[0] | P13 B[0] | P14 B[0] | P15 B[0] | P16 B[0] | P17 B[0] | P18 B[0] | P19 B[0] | P20 B[0] |
| ROW_2 | OFF | OFF | P1 B[1] | P2 B[1] | P3 B[1] | P4 B[1] | P5 B[1] | P6 B[1] | P7 B[1] | P8 B[1] | P9 B[1] | P10 B[1] | P11 B[1] | P12 B[1] | P13 B[1] | P14 B[1] | P15 B[1] | P16 B[1] | P17 B[1] | P18 B[1] |
| ROW_3 | OFF | OFF | OFF | OFF | OFF | OFF | OFF | OFF | OFF | OFF | OFF | OFF | OFF | OFF | OFF | OFF | OFF | OFF | OFF | OFF |
| ROW_4 | OFF | OFF | OFF | OFF | OFF | OFF | P1 B[2] +B[3] | P2 B[2] +B[3] | P3 B[2] +B[3] | P4 B[2] +B[3] | P5 B[2] +B[3] | P6 B[2] +B[3] | P7 B[2] +B[3] | P8 B[2] +B[3] | P9 B[2] +B[3] | P10 B[2] +B[3] | P11 B[2] +B[3] | P12 B[2] +B[3] | P13 B[2] +B[3] | P14 B[2] +B[3] |
| ROW_5 | OFF | OFF | OFF | OFF | OFF | OFF | OFF | OFF | P1 B[4] | P2 B[4] | P3 B[4] | P4 B[4] | P5 B[4] | P6 B[4] | P7 B[4] | P8 B[4] | P9 B[4] | P10 B[4] | P11 B[4] | P12 B[4] |
| ROW_6 | OFF | OFF | OFF | OFF | OFF | OFF | OFF | OFF | OFF | OFF | P1 B[5] | P2 B[5] | P3 B[5] | P4 B[5] | P5 B[5] | P6 B[5] | P7 B[5] | P8 B[5] | P9 B[5] | P10 B[5] |
| ROW_7 | OFF | OFF | OFF | OFF | OFF | OFF | OFF | OFF | OFF | OFF | OFF | OFF | OFF | OFF | OFF | OFF | OFF | OFF | OFF | OFF |
| ROW_8 | OFF | OFF | OFF | OFF | OFF | OFF | OFF | OFF | OFF | OFF | OFF | OFF | OFF | OFF | P1 B[6] +[B7] | P2 B[6] +[B7] | P3 B[6] +[B7] | P4 B[6] +[B7] | P5 B[6] +[B7] | P6 B[6] +[B7] |

FIG. 6B

CIRCUIT AND METHOD FOR DRIVING LIGHT SOURCES

CROSS-REFERENCE TO RELATED APPLICATION

This application a continuation application of and claims the priority benefit of a prior application Ser. No. 16/727,943, filed on Dec. 27, 2019, now allowed. The prior application claims the priority benefit of U.S. provisional application Ser. No. 62/785,228, filed on Dec. 27, 2018. The entirety of the above-mentioned patent application is hereby incorporated by reference herein and made a part of this specification.

BACKGROUND

Technical Field

The disclosure generally relates to light source driving, and more particularly relates to a driving circuit and a method thereof that are capable of improving display quality under high refresh rate.

Description of Related Art

In a light emitting diode (LED) display system, pulse-width modulation (PWM) is used in many applications to drive a plurality of light sources to display multi-bit display data on a display medium. The display system may control a duty ratio (e.g., a percentage of "ON" time period over each cycle) according to data resolution of the multi-bit display data to drive the light sources. For example, a cycle may be divided into 256 units for displaying an 8-bit display data which presents a gray level from 0 to 255. A length of the cycle is inversely proportional to refresh rate of the display system. In other words, as the refresh rate of the display system increases, the length of the cycle decreased. When the length of the cycle is too short compared with response time of the light sources, the display quality of the multi-bit display data is degraded since each cycle may be not long enough to display a full range of gray levels.

As demand for the display applications with fast refresh rate has grown recently, there is a need for a creative technique to improve the display quality under high refresh rate for the LED display system.

Nothing herein should be construed as an admission of knowledge in the prior art of any portion of the present disclosure.

SUMMARY

A driving circuit and a driving method that are capable of improving display quality under high refresh rate are introduced.

In some embodiments, the driving circuit includes a plurality of sub-driving circuits and a plurality of first switching circuits. The plurality of sub-driving circuits is configured to supply a plurality of driving currents to drive a first group of light sources to emit light to form a first pixel on a display medium. The first switching circuits are respectively coupled to the sub-driving circuits and are configured to control the plurality of sub-driving circuits to supply the driving currents to the first group of light sources according to the pixel data, wherein a current value of each of the plurality of driving currents is corresponding to a bit order of a respective bit of the pixel data.

In some embodiments, the driving method includes steps of supplying, by a plurality of sub-driving circuits, a plurality of driving currents to drive a first group of light sources to emit light to form a first pixel on a display medium; and controlling, by a plurality of first switching circuits, the plurality of sub-driving circuits to supply the driving currents to the first group of light sources according to the pixel data, wherein a current value of each of the plurality of driving currents is corresponding to a bit order of a respective bit of the pixel data.

To make the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

FIGS. 2C through 2D are timing diagrams illustrating driving operations of a driving circuit in accordance with some embodiments.

FIG. 3B is a timing diagram illustrating driving operations of a driving circuit in accordance with some embodiments.

FIG. 6B is a timing diagram illustrating driving operations of a driving circuit for compensating defect light sources in accordance with some embodiments.

DESCRIPTION OF THE EMBODIMENTS

It is to be understood that other embodiments may be utilized and structural changes may be made without departing from the scope of the present disclosure. Also, it is to be understood that the phraseology and terminology used herein are for the purpose of description and should not be regarded as limiting.

Figure 1:
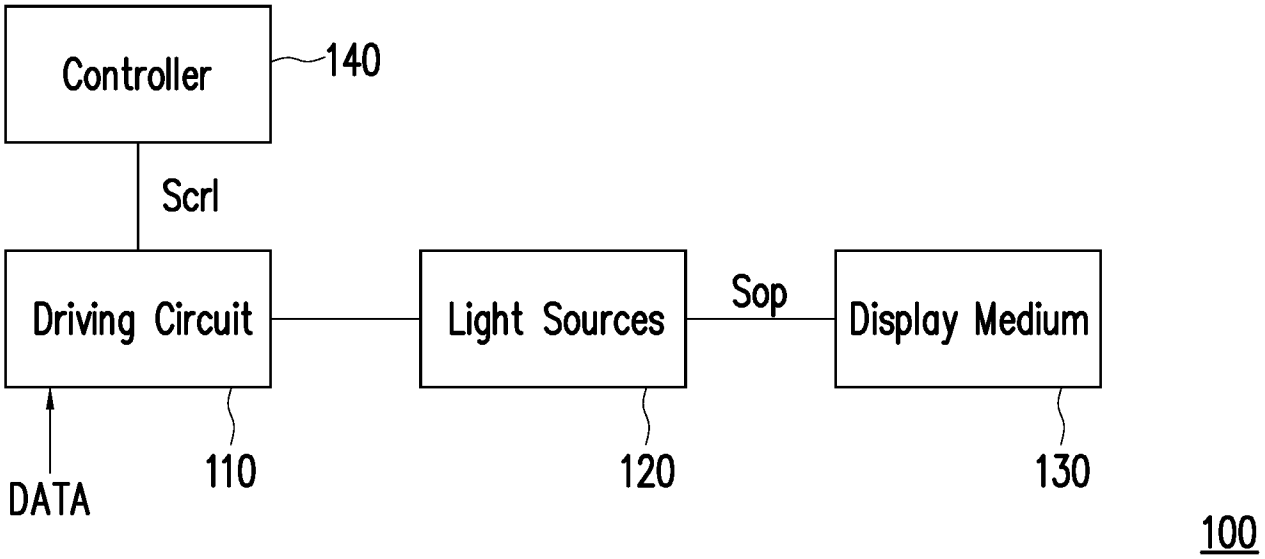
FIG. 1 is a schematic diagram of a display system in accordance with some embodiments.

FIG. 1 illustrates a display system 100 in accordance with some embodiments. The display system 100 may include a driving circuit 110, a plurality of light sources 120, a display medium 130 and a controller 140. The driving circuit 110 is coupled to the light sources 120 and is configured to drive light sources 120 to emitting lights or optical signals Sop to the display medium 130 so as to form pixels of a display frame on the display medium 130. The driving circuit 110 may drive the light sources 120 according to display data (or pixel data) DATA. In some embodiments, the driving circuit 110 may include at least one bias current generating circuit (not shown) that is configured to generate reference currents with different current levels. The driving circuit 110 may drive the light sources 120 according to the reference currents and the display data DATA to form the display frame on the display medium 130. In some embodiments, the display medium 130 may be a projection screen and the lights from the light sources 120 are projected to the projection screen to form the pixels of the display frame. In another embodiments, the display medium 130 may be a human retina and the lights from the light sources 120 are projected to the retina. The lights may be projected to the display medium by using optical components such as prisms, lens, or mirrors. In still another embodiments, the display medium 130 may be a display panel where the light sources 120 are disposed. The controller 140 is coupled to the driving circuit 110 and is configured to control the operations of the driving circuit 110 according to a control signal Scrl. In some embodiments, the controller 140 includes logic circuits that are configured to generate the control signals Scrl to control the driving circuit 110. In some embodiments, the light sources 120 may be arranged as an array for emitting lights of the same color, such as red, green, blue or white, or other color such as cyan, magenta or yellow, which is not limited. In some embodiments, the display system 100 may include multiple arrays of the light sources 120 for emitting lights of different colors, such as red light, green light and blue light, and the lights of different colors may be projected to form a full-color pixel on the display medium. In some other embodiments, the display system 100 may include multiple arrays of the light sources 120 for emitting white lights, and the white lights may be projected, through color filtering devices, to form a full-color pixel on the display medium.

Figure 2A:
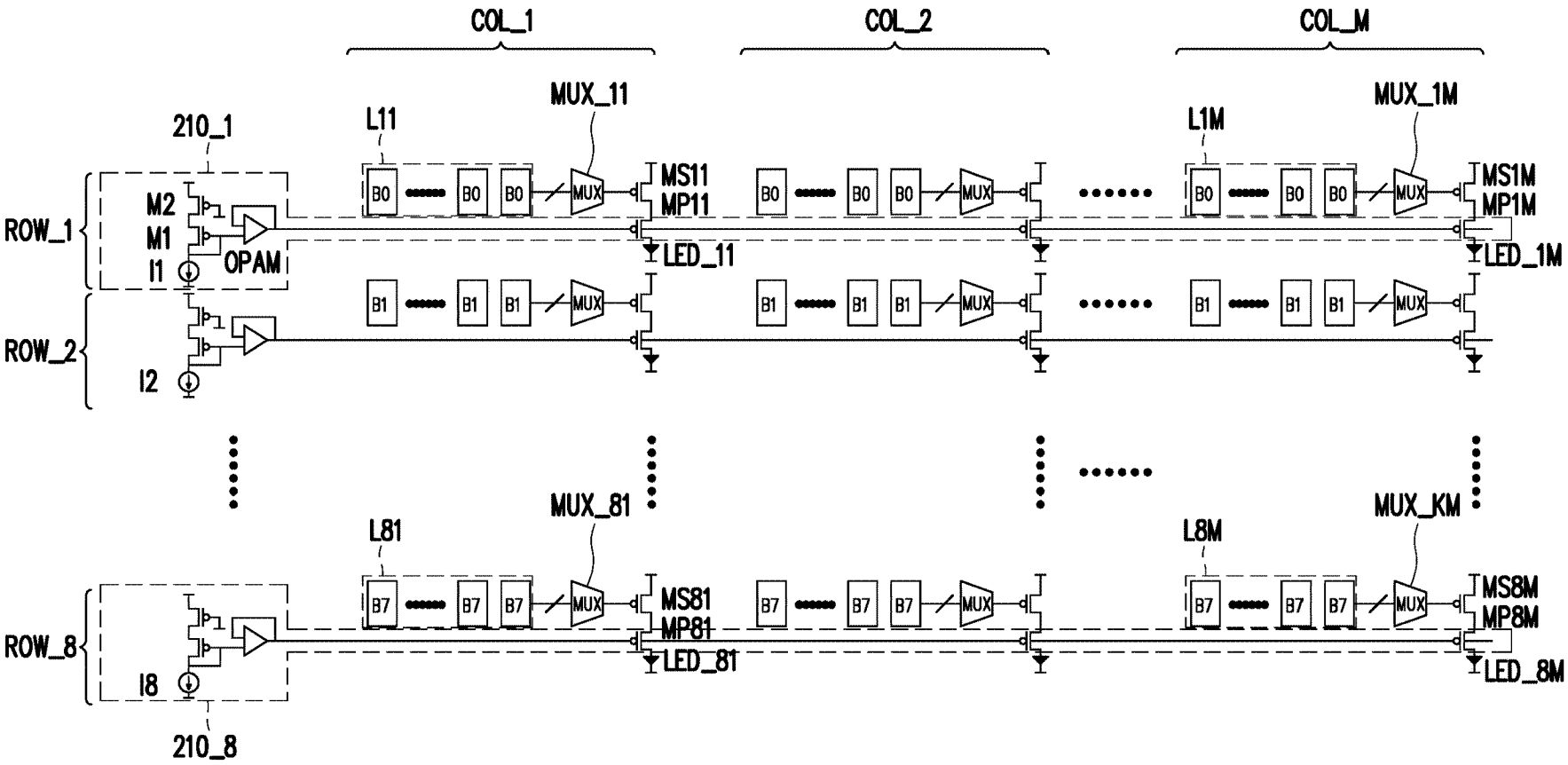
FIG. 2A is a schematic diagram of a driving circuit for driving a plurality of light sources in accordance with some embodiments.

FIG. 2A illustrates a schematic diagram of a driving circuit 210 for driving a plurality of light sources LED_11 through LED_8M, which may be disposed as an N*M light source array where N=8 in this example, in accordance with some embodiments, where M is a positive integer. The light sources LED_11 through LED_8M may be arranged in an N*M array where N=8, including rows ROW_1 through ROW_8 and columns COL_1 through COL_M. The light sources that are located in the same column are referred to as a first group of light sources; and the light sources that are located in the same row are referred to as a second group of light sources. For example, the first group of light sources may be the light source column COL_1 including the light sources LED_11 through LED_81, and the second group of light sources may be the light source row ROW_1 including the light sources LED_11 through LED_1M. The light sources LED_11 through LED_8M may be light-emitting elements (LED), micro-LED, micro organic LED (OLED), or any other suitable light sources that are capable of emitting lights.

The driving circuit 210 may include a plurality of sub-driving circuits 210_1 through 210_8, a plurality of latch circuits L11 through LBM, a plurality of multiplexers MUX_11 through MUX_8M, and a plurality of switching circuits MS11 through MS8M. In the aspect of light source rows, each of the sub-driving circuits 210_1 through 210_8 is configured to supply driving currents to M light sources of a corresponding light source row (i.e. the second group of light sources) among ROW_1 through ROW_8. In the aspect of light source columns, the sub-driving circuits 210_1 through 210_8 are configured to supply driving currents to eight light sources of a corresponding light source column (i.e., the first group of current sources) among COL_1 through COL_M. For driving the light source column COL_1 to emit light to form a first pixel on the display medium, the associated parts in the driving circuit 210 are the sub-driving circuits 210_1 through 210_8, the latch circuits L11 through L81 and the multiplexers MUX_11 through MUX_81. A pixel of a display frame is displayed (by projection) by the light sources of a light source column emitting lights time-divisionally, which means driving currents generated by the sub-driving circuits 210_1 to 210_8 are time-divisionally supplied to the light sources of the light source column. Some timing control schemes are shown in FIG. 2C and FIG. 2D illustrated later. In some embodiments, the quantity (i.e. N) of the sub-driving circuits 210_1 through 210_N is corresponding to the data resolution of pixel data to be displayed on the display medium. For example, if the pixel data to be displayed on the display medium (e.g., display medium 130 in FIG. 1) has 8 bits, eight sub-driving circuits are included in the driving circuit 210. The sub-driving circuits drives the first group of light sources in a time-divisional manner to emit lights so as to form the first pixel on the display medium by visual persistence.

Figure 2B:
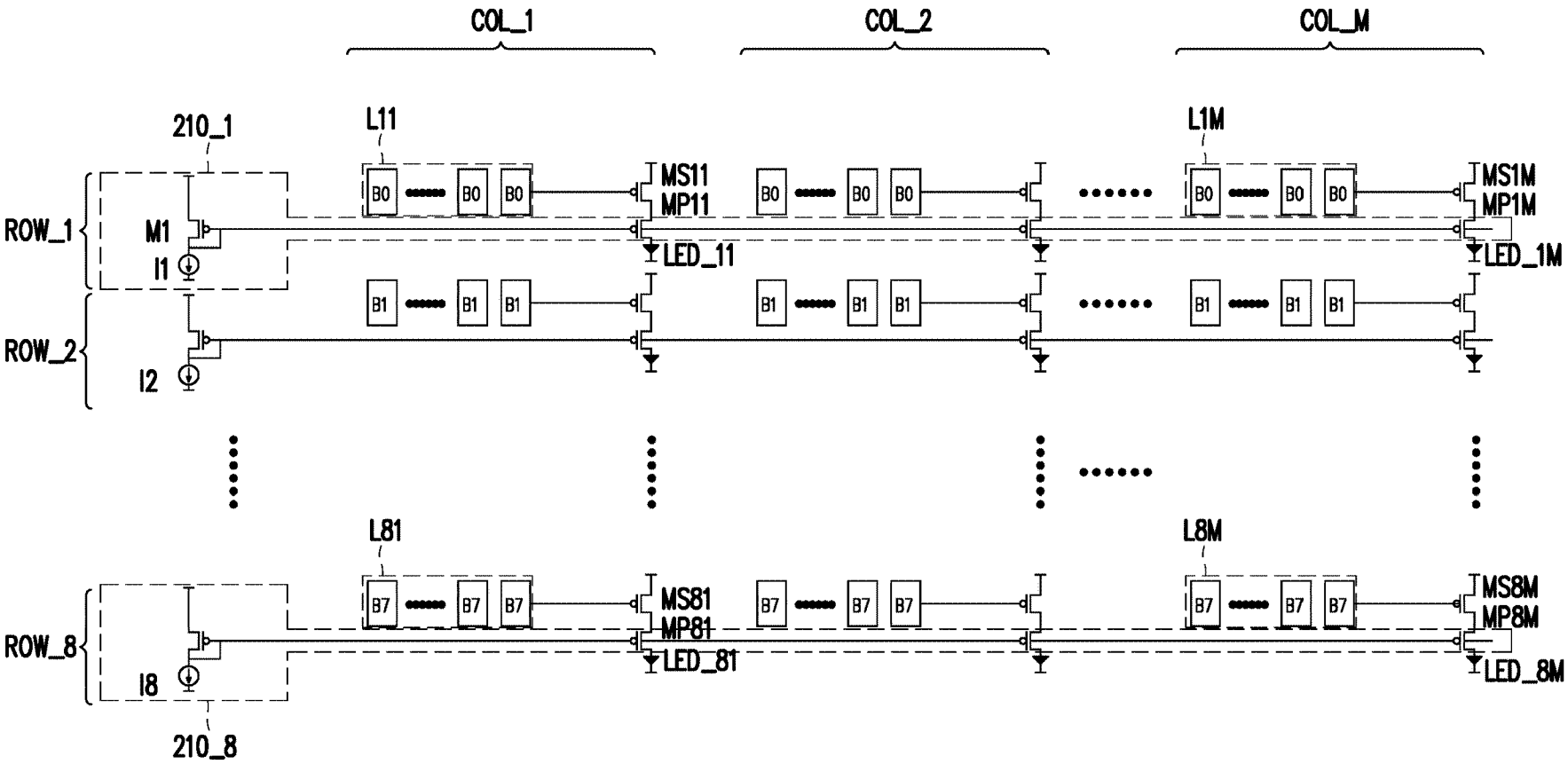
FIG. 2B is a schematic diagram of a driving circuit for driving a plurality of light sources in accordance with some embodiments.

FIG. 2B is a schematic diagram of a driving circuit for driving a plurality of light sources in accordance with some embodiments. Based on the example illustrated in FIG. 2B, the plurality of multiplexers MUX_11 through MUX_8M may be not required.

In some embodiments, each of the sub-driving circuits 210_1 through 210_8 includes a bias current generating circuit and a current mirror circuit. For example, the sub-driving circuit 210_1 includes a bias current generating circuit formed by a current source generating a reference current I1 (which is also cited as the current source I1 hereinafter) and a current mirror circuit CM1 including an input current mirror transistor M1 and output current mirror transistors MP11 to MP1M, which are PMOS transistors in this example but not limited herein. The current mirror circuit CM1 generate a plurality of output currents, which is taken as driving currents, respectively for the light sources LED_11 through LED_1M, wherein each output current has the same current value as the reference current I1. Each of the sub-driving circuits 210_2 to 210_8 include a circuitry (i.e. a bias current generating circuit and a current mirror circuit) similar to the sub-driving circuits 210_1 and are not repeated herein. The output currents generated by the current mirror circuit CM1 are supplied to the light source ROW_1 at the same time. In this embodiment, for providing sufficient driving capability to a large amount of light sources in each light source row, each sub-driving circuit may further include an operational amplifier OPAM disposed between the gate terminal of the input current mirror transistor and the gate terminals of the output current mirror transistors in the current mirror circuit. In this embodiment, each sub-driving circuit may further include a transistor M2 coupled to the input current mirror transistor M1 for circuit symmetry. In some embodiments, the operational amplifier OPAM and the transistor M2 may be not required, which is also illustrated in FIG. 2B.

With respect to a pixel of the display frame, such as the first pixel corresponding to the light source column COL_1, the sub-driving circuits 210_1 to 210_8 generate eight different driving currents respectively for the light sources LED_11 to LED_81 of the light source column COL_1, and these eight different driving currents are time-divisionally supplied to the light sources LED_11 to LED_81 under the control of plurality of switching circuits MS11 through MS81. The values of reference currents I1 through I8 generated by the bias current generating circuits of the sub-driving circuits 210_1 through 210_8 are configured according to different bit orders of the pixel data. Taking 8-bit pixel data as an example, the reference current I1 is corresponding to bit 0 of the pixel data and configured to be $2^0$*I; the the reference current I2 is corresponding to bit 1 of the pixel data and configured to be $2^1$*I; the the reference current I3 is corresponding to bit 2 of the pixel data and configured to be $2^2$*I, and so forth, wherein I is a predetermined current. Thus, the reference currents I1 through I8 are configured to be 1*I, 2*I, 4*I, 8*I, 16*I, 32*I, 64*I and 128*I respectively.

In some embodiments, the current values of the reference currents I1 through I8 may be changed periodically (e.g. by display frames) as the current values are scrolling, which can avoid the light sources of each row being always driven by the same current value, such that influence of light source device mismatch due to manufacturing may be eliminated. An exemplary scrolling function is illustrated in Table 1, with respect to driving the light sources to display a display frame 1 (e.g., to emit lights which are projected to a projection screen), the reference currents I1 through I8 are configured to be 1*I, 2*I, 4*I, 8*I, 16*I, 32*I, 64*I and 128*I respectively; with respect to driving the light sources to display a display frame 2 next to the display frame 1, the reference currents I1 through I8 are configured to be 128*I, 1*I, 2*I, 4*I, 8*I, 16*I and 64*I respectively; with respect to driving the light sources to display a display frame 3 next to the display frame 2, the reference currents I1 through I8 are configured to be 64*I, 128*I, 1*I, 2*I, 4*I, 8*I, 16*I and 32*I respectively. When the scrolling function is applied on setting of the reference currents, the bit order of a bit of pixel data stored in a latch circuit may change correspondingly by display frames, which is described in detail later.

TABLE 1

| | Display frame 1 | Display frame 2 | Display frame 3 |
|---|---|---|---|
| 11 | 1*I | 128*I | 128*I |
| 12 | 2*I | 1*I | 128*I |
| 13 | 4*I | 2*I | 1*I |
| 14 | 8*I | 4*I | 2*I |
| 15 | 16*I | 8*I | 4*I |
| 16 | 32*I | 16*I | 8*I |
| 17 | 64*I | 32*I | 16*I |
| 18 | 128*I | 64*I | 32*I |

A display frame including a row of pixels P11 through P1M which are 8-bit pixel data is given as an example for illustrating the following description. Based on this example, the pixel P11 is displayed by the eight light sources LED_11 through LED_81 which emit lights time-divisionally, and the latch circuits L11 through L81 are configured to store different bits of pixel data of the pixel P11. Similarly, the pixel P1M is displayed by the eight light sources LED_1M through LED_8M which emit lights time-divisionally, and the latch circuits L1M through L8M are configured to store different bits of pixel data of the pixel P11. Each latch circuit may include one or more latches. In some embodiments, the quantity of the latches in each of the latch circuits L11 through L8M are identical to one another, but the disclosure is not limited thereto.

For example, the latch circuit L11 may store a bit 0 (least significant bit), denoted by B[0], of the the pixel P11, the latch circuit L21 may store a bit 1, denoted by B[1], of the pixel P11, and the latch circuit L81 may store a bit 7 (most significant bit), denoted by B[7], of the pixel P11. In some embodiments, the quantity of the latch circuits for storing pixel data of a pixel is corresponding to the data resolution of the pixel data. The bit stored in each latch circuit may be either 1 or 0 and may be utilized as a control signal or to generate a control signal, to control a conduction status of a corresponding switching circuit. As a result, a driving current is supplied to a corresponding light source when the corresponding switching circuit is conducted, and the driving current is not supplied to the corresponding light source when the corresponding switching circuit is not conducted. In a case of each latch circuit storing only one bit of pixel data of a pixel, the stored bit may control the corresponding switching circuit without being through a multiplexer. A converting circuit for converting the digital bit (0 or 1) to the control signal capable of turning on or off the switching circuit is not presented in figures.

For example, the switching circuits MS11 through MS81 are respectively coupled to the sub-driving circuits 210_1 through 210_8 and are configured to control the sub-driving circuits 210_1 through 210_8 according to bits of the pixel data of the pixel 11 (respectively stored in the latch circuits L11 through L81) to supply the different driving currents time divisionally to the light sources LED_11 through LED_81 of the light source column COL_1 (regarded as the first group of light sources). Similarly, the switching circuits MS1M through MS8M are respectively coupled to the sub-driving circuits 210_1 through 210_8 and are configured to control the sub-driving circuits 210_1 through 210_8 according to bits of the pixel data of the pixel 1M (respectively stored in the latch circuits L1M through L8M) to supply the different driving currents time divisionally to the light sources LED_1M through LED_8M of the light source column COL_1 (regarded as the first group of light sources). In some embodiment, the switching circuits MS11 through MS81 may be implemented by transistors and the control terminals of the switching circuits MS11 through MS81 may receive respective control signals generated based on the bits stored in the latch circuits L11 through L81.

In some embodiments, each of the latch circuits L11 through L8M is configured to store at least two bits of a same bit position with respect to at least two pixels on the display medium. Each of the multiplexers MUX_11 through MUX_8M is coupled between one of the latch circuits L11 through L8M and one of the switching circuits MS11 through MS8M, and is configured to time-divisionally output at least two control signals which are generated based on at least two bits of a same bit position with respect to at least two pixels stored in the latch circuit L11 through L8M, to control the switching circuits MS11 through MS8M. For example, the multiplexer MUX_11 is coupled between the latch circuit L11 and the switching circuit MS11, and is configured to output a first control signal corresponding to a first bit stored in the latch circuit L11 during a first unit period to control the switching circuit M11_1 and output a second control signal corresponding to a second bit stored in the latch circuit L11 during a second unit period to control the switching circuit MS11.

FIG. 2C is an exemplary timing diagram for driving the light sources according to 8-bit pixel data B[0] through B[7] to form pixels of a N*M pixel array including pixels $P_{1,1}$ through $P_{N,M}$ on the display medium, where N, M are integer and N=20 for illustration purpose. In the exemplary timing diagrams of the present disclosure, Pn denotes a row of pixels, including pixels $P_{n,1}$ through $P_{n,M}$. T1-T20 denotes unit periods. In this example, the ratio of the light source and the pixel pitch on the display medium is 1:1, which means light emitting by a light source can be projected to the range of a target pixel. The light source rows ROW_1 through ROW_8 respectively emit lights according to different bits of 8-bit pixel data. As such, in each unit period, each light source row is driven according to a bit of 8-bit pixel data and it needs eight unit periods (taken as a cycle) to display 8-bit pixel data of a pixel on the display medium. Referring to FIG. 2A and FIG. 2C, in the unit period T1, the driving circuit is configured to control the light sources LED_11 through LED_1M in the light source row ROW_1 to emit light according to a plurality of bits B[0] of pixel data of the pixels $P_{1,1}$ through $P_{1,M}$ (which are briefly denoted by a pixel row P1). In the unit period T2, the driving circuit is configured to control the light source LED_21 (not shown) through LED_2M (not shown) in the light source row ROW_2 to emit lights according to the a plurality of bits B[1] of the pixel data of the pixels $P_{1,1}$ through $P_{1,M}$. Similarly, in subsequent unit periods from T3 to T8, the driving circuit may control the light sources in the light source rows ROW_3 through ROW_8 time divisionally to emit light according to the bits B[2] through B[7] of the pixel data of the pixels $P_{1,1}$ through $P_{1,M}$ in the display medium. From the above, after the cycle having eight unit periods, the pixel row P1 of the display frame is completely displayed. The other pixel rows P2 through P20 may be formed in the display medium in a similar manner, thus the detailed description is omitted hereafter. By such a time-divisionally driving control scheme, the human perceptive luminance of a pixel on the display medium is formed by visual persistence, and the luminance of the pixel may be positively related to a result of summing driving currents of corresponding light sources. For example, with respect to a pixel $P_{1,1}$ among the pixel row R1 on the display medium, the luminance of the pixel $P_{1,1}$ may be positively related to a result of summing driving currents for the light sources LED_11 through LED_81 of the light source column COL_1, denoted by $I_{P1,j}$, which may be calculated by equation (1), where I1 to I8 are reference currents which respectively equal to the driving currents for the corresponding light sources and I is the predetermined current.

$$I_{P1,j}=I1*P_{1,j}_B[0]+I2*P_{1,j}_B[1]+I3*P_{1,j}_B[2]+I4*P_{1,j}_B[3]+I5*P_{1,j}_B[4]+I6*P_{1,j}_B[5]+I7*P_{1,j}_B[6]+I8*P_{1,j}_B[7]=1*I*P_{1,j}_B[0]+2*I*P_{1,j}_B[1]+4*I*P_{1,j}_B[2]+8*I*P_{1,j}_B[3]+16*I*P_{1,j}_B[4]+32*I*P_{1,j}_B[5]+64*I*P_{1,j}_B[6]+128*I*P_{1,j}_B[7] \quad (1)$$

FIG. 2D illustrates an exemplary timing diagram for driving the light sources according to 8-bit pixel data B[0] through B[7] to form pixels of a N*M pixel array including pixels $P_{1,1}$ through $P_{N,M}$ on the display medium, where N, M are integer and N=20 for illustration purpose. In this example, the ratio of the light source and the pixel pitch on the display medium is 2:1, which means light emitting by a light source can be projected to the range of two pixels. A difference between the timing diagram shown in FIG. 2C and the diagram shown in FIG. 2D is that the bit values of every pixel row, such as the pixel row P1 (including pixels $P_{n,1}$ through $P_{n,M}$) are not displayed in continuous unit periods but displayed by, which is illustrated by shadow in FIG. 2D. For example, the bits B[0] of all the pixel data of the pixel row P1 are displayed in the unit period T1, the bits B[1] of all the pixel data of the pixel row P1 are displayed in the unit period T3 instead of the unit period T2 as illustrated in FIG. 2C, and the bits B[2] of all the pixel data of the pixel row P1 are displayed in the unit period 15 instead of the unit period T3 as illustrated in FIG. 2C, and so forth. Besides, the bits B[0] of all the pixel data of the pixel row P2 are displayed in the unit period T2, the bits B[1] of all the pixel data of the pixel row P2 are displayed in the unit period T4, and so forth. From the above, by the cycle having 15 unit periods (such as from T1 to T15), each pixel row of the display frame is completely displayed. Under such a time-divisionally driving control scheme of FIG. 2D, the luminance of the pixel $P_{1,1}$ may be positively related to a result of summing driving currents for the light sources LED_11 through LED_81 of the light source column COL_1, and driving current summation $I_{P1,j}$ may be also calculated by equation (1).

Figure 3A:
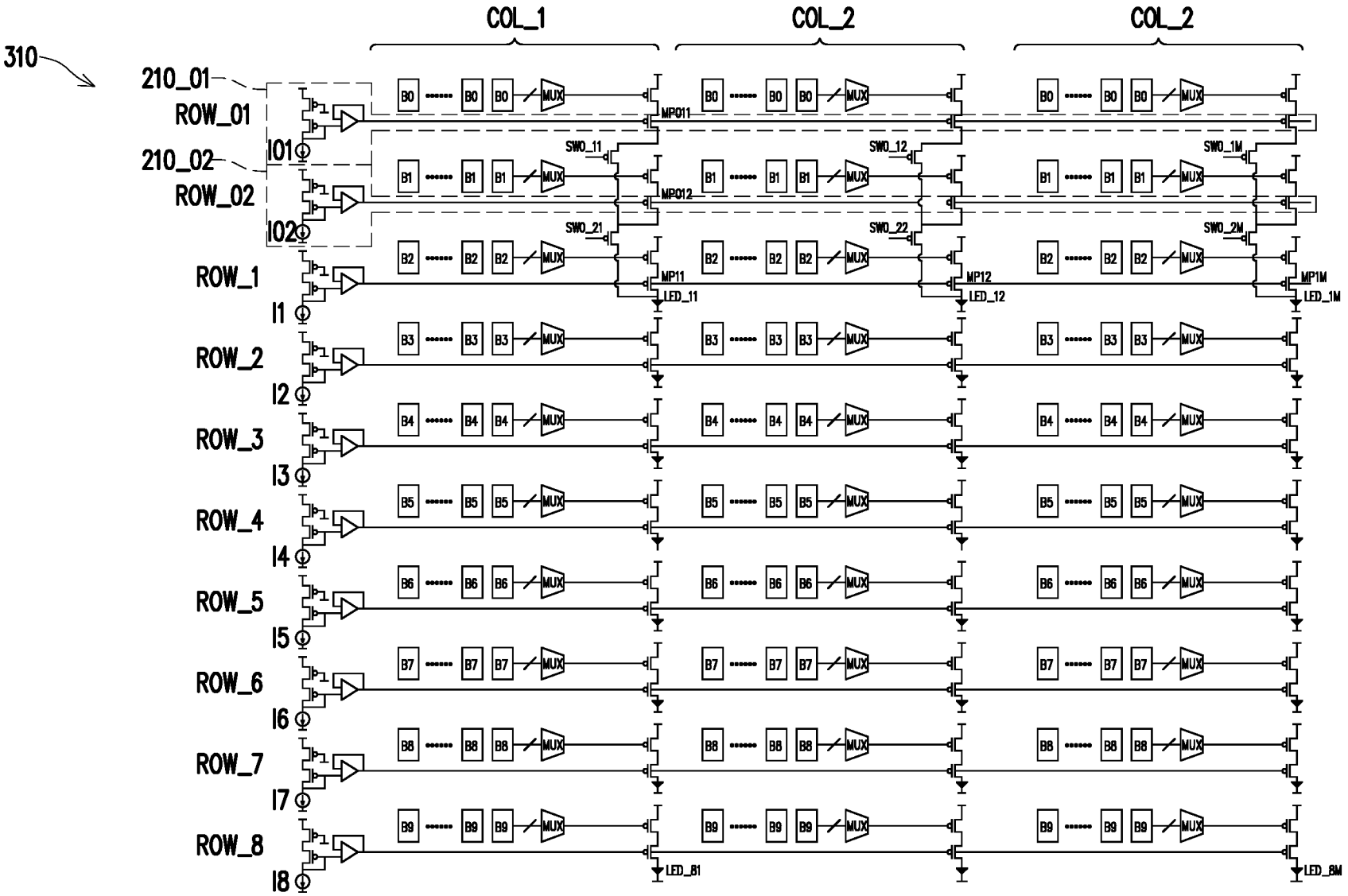
FIG. 3A is a schematic diagram of a driving circuit having a current summation circuit in accordance with some embodiments.

FIG. 3A illustrates a schematic diagram of a driving circuit 310 for driving a plurality of light sources LED_11 through LED_8M which may be disposed as an N*M light source array where N=8 in this example in accordance with some embodiments. The same components of the driving circuits in FIG. 3A and FIG. 2A are indicated by same reference numbers. A difference between the FIG. 3A and FIG. 2A is that the driving circuit 310 in FIG. 3A further includes additional sub-driving circuits 210_01 and 210_02 and a current summation circuit, which may be implemented by switches SW0_11, SW0_21, SW0_12, SW0_22 . . . through SW0_1M and SW0_2M in this example. Each of the additional sub-driving circuits 210_01 and 210_02 may include additional bias current generating circuit and an additional current mirror circuit. The additional bias current generating circuit in each of the additional sub-driving circuit is similar to the bias current generating circuit in each of the sub-driving circuit except for the current value of the current sources. The additional bias current generating circuit of the additional sub-driving circuits 210_01 and 210_02 includes the current sources 101 and 102 generating reference currents which are also denoted by 101 and 102, respectively. The structure of the additional sub-driving circuits 210_01 and 210_02 are similar to the structure of the sub-driving circuit 210_1 and 210_8, thus the detailed description is omitted hereafter. Each of additional sub-driving circuits 210_01 and 210_02 may generate a plurality (which equals to M) of driving currents. In some embodiments, the total number of the sub-driving circuits (e.g., sub-driving circuits 210_1 through 210_8) and the additional sub-driving circuits 210_01 and 210_02 is corresponding to a second data resolution that is greater than the first data resolution. For example, when the data resolution of the display data is 10-bit display data, the driving circuit 310 may include eight sub-driving circuits and two additional sub-driving circuits. Since the additional sub-driving circuits are utilized for increasing data resolution, the reference currents generated by the additional bias current generating circuits may be preconfigured to present the extra two bits of pixel data. For example, the reference current I01 may be preconfigured to be (¼)*I and the reference current I02 may be preconfigured to be (½)*I, where I is the predetermined current.

The current summation circuit is utilized for transferring the driving currents supplied by the sub-driving circuit 210_01 and the other driving currents supplied by the sub-driving circuit 210_02 to anyone of the light source rows ROW_1 through ROW_8, such as transferring to the light source row ROW_1 in this example, according to the control of the switches in the current summation circuit. In the current summation circuit, the switches SW0_11 through SW0_1M may be respectively coupled between a plurality of output current mirror transistors (such as M01_2) of the additional sub-driving circuit 210_01 and a plurality of output current mirror transistors (such as M02_2) of the additional sub-driving circuit 210_02. The switches SW0_21 through SW0_2M may be respectively coupled between a plurality of output current mirror transistors (such as M02_2) of the additional sub-driving circuit 210_02 and the plurality of output current mirror transistors MP11 through MP1M of the sub-driving circuit 210_1 (referred to FIG. 2A). The switching operations of the switches of the current summation circuit may be controlled by a controller (e.g., controller 140 in FIG. 1). For example, when the switches SW0_11 and SW0_21 are turned on to form the electrical connections among the output current mirror transistors M01_2 and M02_2 and MP11, the driving current supplied to the light source LED_11 could be summed to equal to ¼*I+½*I+1*I, where I is the predetermined current.

FIG. 3B is a timing diagram for driving the light sources according to 10-bit pixel data B[0] through B[9] to form pixels of a N*M pixel array including pixels $P_{1,1}$ through $P_{N,M}$ on the display medium in accordance with some embodiments, where N, M are integer and N=20 for illustration purpose. Referring to FIG. 3A and FIG. 3B, when the switches SW0_11 through SW0_1M and SW0_21 through SW0_2M of the current summation circuit are turned on, the driving currents (generated by the additional sub-driving circuits) corresponding to the bit data B[0] and B[1] of the pixels of the pixel row R1 are added to the driving current corresponding to the bit B[2] of the pixels of the pixel row R1, such that each of the light sources LED_11 through LED_1M is driven by a summed driving current. The light sources in light source rows ROW_2 through ROW_8 are used to display bits B[3] through B[9] of the pixel data of the pixels of the pixel row R1. As such, the driving circuit 310 may control the light sources according to the 10-bit display data to form pixels in the display medium. In this example shown in FIG. 3B, the ratio of the light source and the pixel pitch on the display medium is 2:1, such that a cycle for completely displaying a pixel row on the display medium equals 15 unit periods (such as from T1 to T15). The luminance of the a pixel $P_{1,j}$ in the pixel row P1 on the display medium may be positively related to a result of summing driving currents, which may be calculated according to equation (2):

$$\begin{aligned} I_{P1,j} &= \{I01*P_{1,j}_B[0]+I02*P_{1,j}_B[1]+I1*P_{1,j}_B[2]\}+ \\ &I2*P_{1,j}_B[3]+I3*P_{1,j}_B[4]+I4*P_{1,j}_B[5]+I5*P_{1,j}_B[6]+I6*P_{1,j}_B[7]+I7*P_{1,j}_B[8]+I8*P_{1,j}_B[9] \\ &= \{¼*I*P_{1,j}_B[0]+½*I*P_{1,j}_B[1]+1*I*P_{1,j}_B[2]\}+2*I*P_{1,j}_B[3]+4*I*P_{1,j}_B[4]+8*I*P_{1,j}_B[5]+ \\ &16*I*P_{1,j}_B[6]+32*I*P_{1,j}_B[7]+64*I*P_{1,j}_B[8]+128*I*P_{1,j}_B[9] \end{aligned} \quad (2)$$

Figure 4A:
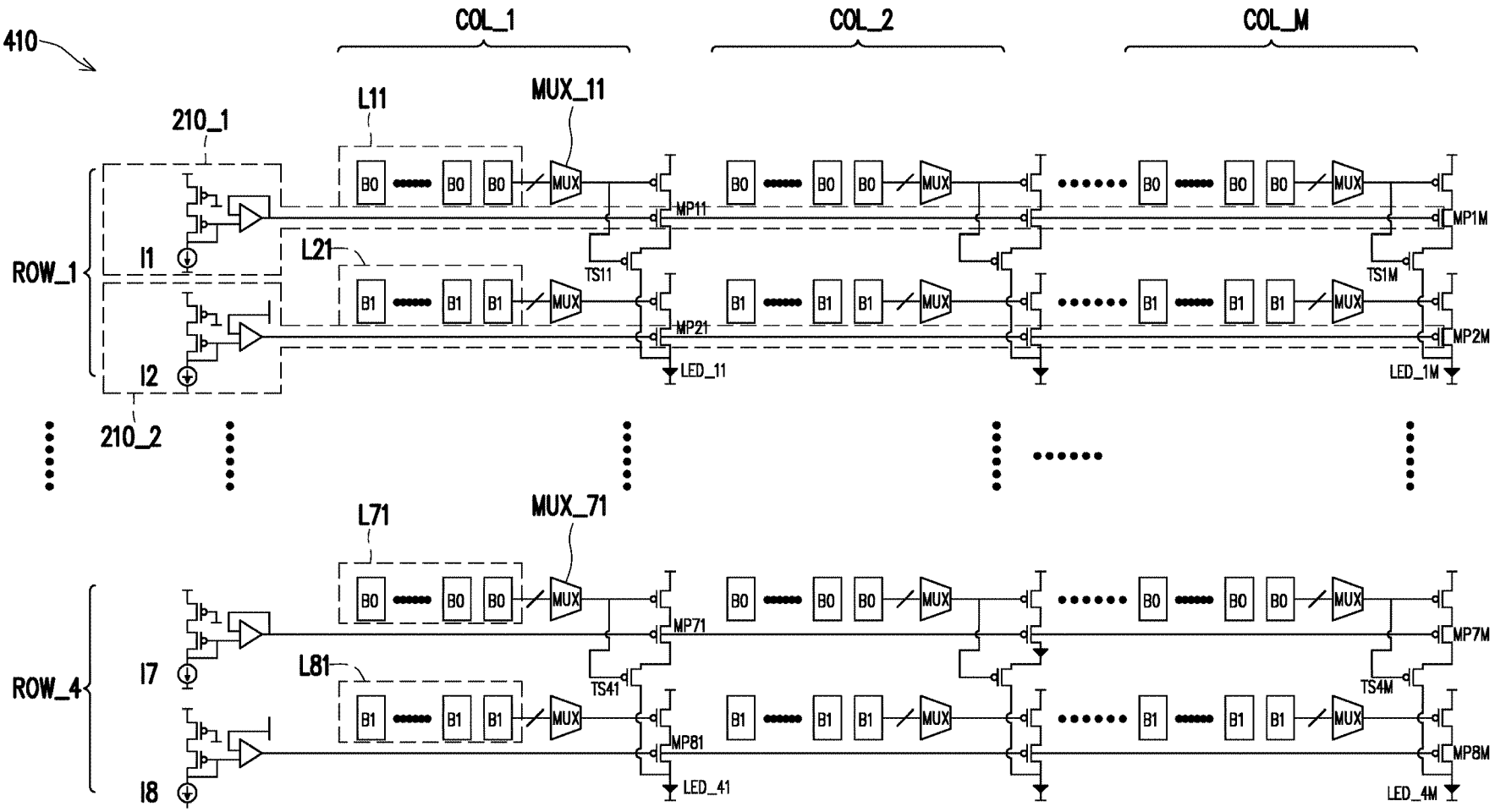
FIG. 4A is a schematic diagram of a driving circuit having a current transferring circuit in accordance with some embodiments.

FIG. 4A illustrates a schematic diagram of a driving circuit 410 for driving 4 rows of light sources, including a first light source row ROW_1 including LED_11 through LED_1M, a second light source row ROW_2 including LED_21 through LED_2M (not shown), a third light source row ROW_3 including LED_31 through LED_3M (not shown), and a fourth light source row ROW_4 including LED_41 through LED_4M4, which are also arranged in columns COL_1 through COL_M, in accordance with some embodiments. A difference between the driving circuit 410 shown in FIG. 4A and the driving circuit 210 shown in FIG. 2A is that each light source row (i.e. the second group of the light sources) in FIG. 4A is driven by two sub-driving circuits 210_1 and 210_2, while each of the second group of the light sources in FIG. 2A is driven by one sub-driving circuit. The driving circuit 410 may be utilized for maintaining 8-bit data resolution under a case that the number of light source rows for displaying pixel data is reduced to four light source rows.

Another difference between the driving circuit 410 shown in FIG. 4A and the driving circuit 210 shown in FIG. 2A is that the driving circuit 410 further includes a current transferring circuit that is formed by the switches TS11 through TS4M. Each of the switches TS11 through TS4M is coupled between the output terminals of two output current mirror transistors of a pair of the sub-driving circuits. More particularly, the switches TS11 through TS1M are respectively coupled between the output terminals of the output current mirror transistors MP11 through MP1M of the sub-driving circuit 210_1 and the output terminals of the output current mirror transistors MP21 through MP2M of the sub-driving circuit 210_2. Similarly, the switches TS41 through TS4M are respectively coupled between the output terminals of the output current mirror transistors MP71 through MP7M of the sub-driving circuit 210_1 and the output terminals of the output current mirror transistors MP81 through MP8M of the sub-driving circuit 210_2. In a case of the ratio of the light source and the pixel pitch on the display medium being not 1:1, the control (gate) terminal of the switch TS11 may be coupled to an output of the multiplexer MUX_11 to time-divisionally receive a bit B[0] of pixel data stored in the latch circuit L11. In other words, the switch TS11 of the current transferring circuit is controlled by data bit stored in the latch circuit L11.

For example, the switches TS11 through TS1M may be controlled based on bits B[0] of pixel data of a pixel row (stored in the latch circuits) to respectively transfer or not to transfer the driving currents from the output current mirror transistors MP11 through MP1M of the sub-driving circuit 210_1 to the output terminal of the output current mirror transistors MP21 through of MP2M of the sub-driving circuit 210_2. In this way, when the switches TS11 through TS4M of the current transferring circuit are controlled to be turned on or off according to stored bits in the latch circuits, the driving circuit 410 with eight sub-driving circuits may be used to drive the group of four light source rows using 8-bit display data. In a case that the switches TS11 through TS4M of the current transferring circuit are set to turned off, the driving circuit 410 with eight sub-driving circuits may be used to drive the group of eight light source rows using 8-bit display data (e.g., FIG. 2A). As such, the flexibility of the driving circuit 410 is improved.

Figure 4B:
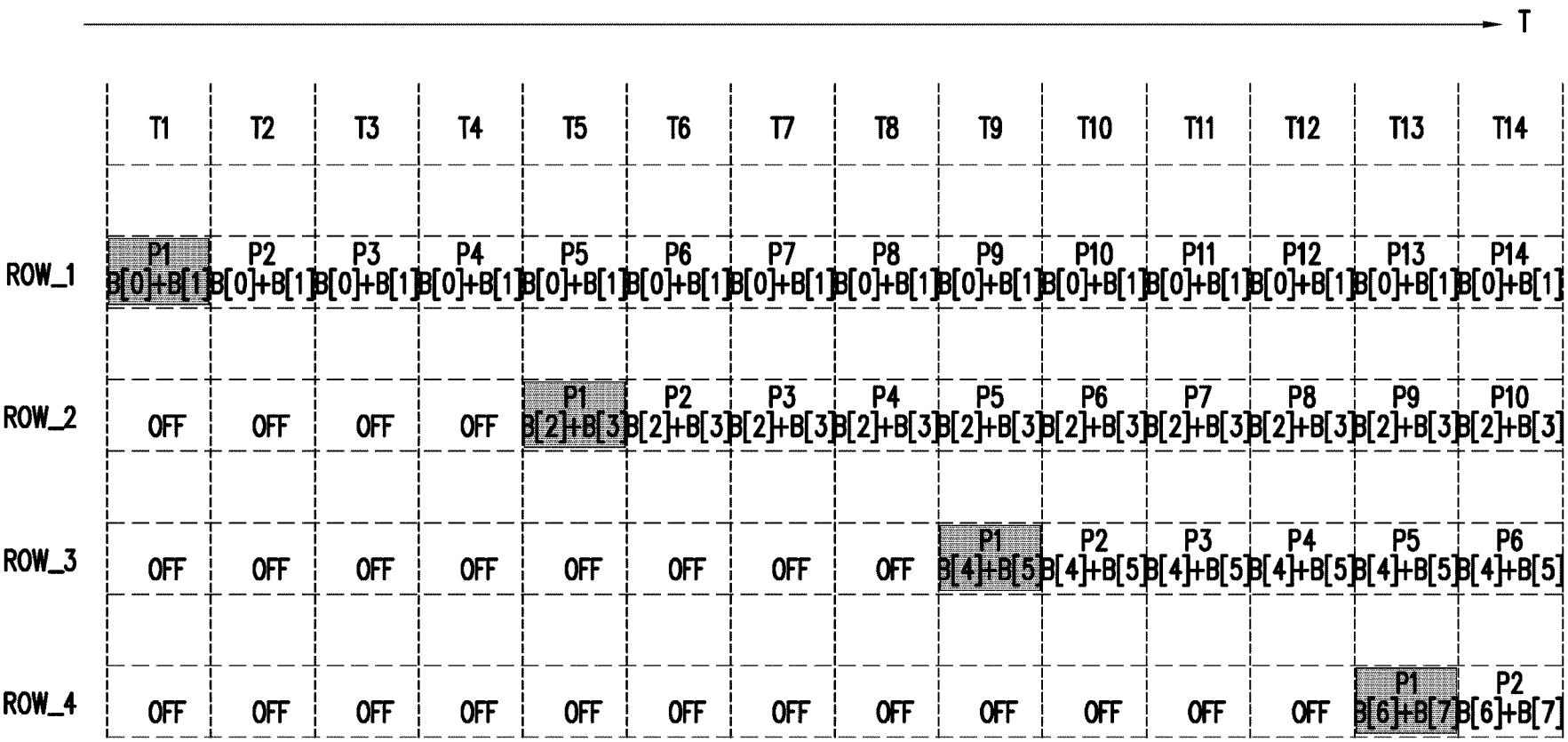
FIG. 4B is a timing diagram illustrating driving operations of a driving circuit in accordance with some embodiments.

FIG. 4B is a timing diagram for driving the light sources according to 8-bit pixel data B[0] through B[7] to form pixels on the display medium in accordance with some embodiments. Referring to FIG. 4A and FIG. 4B, in the unit period T1, the switches TS11 through TS1M of the current transferring circuit may respectively transfer driving currents corresponding to bits B[0] of pixel data of the pixel row P1 to the output terminals of the output current mirror transistors MP21 through MP2M, such that the driving currents corresponding to bits B[0] of pixel data of the pixel row P1 and the driving currents corresponding to bits B[1] of pixel data of the pixel row P1 are respectively summed. As such, in the unit period T1, the light sources LED_11 through LED_1M in the light source row ROW_1 are driven according to the respective summed driving currents corresponding to bits B[0] and B[1] of pixel data of the pixel row P1. Similarly, in the unit period T2, the light source row ROW_1 are driven according to respective summed driving currents corresponding to bits B[0] and B[1] of pixel data of a pixel row P2; in the unit period T3, the light source row ROW_1 are driven according to respective summed driving currents corresponding to bits B[0] and B[1] of pixel data of a pixel row P3; in the unit period T4, the light source row ROW_1 are driven according to respective summed driving currents corresponding to bits B[0] and B[1] of pixel data of a pixel row P4. During T1 to T4 the light source rows except ROW_1 are not driven ("OFF"). In the unit period T5, the light sources in the light source row ROW_2 are driven according to respective summed driving current corresponding to bits B[2] and B[3] of pixel data of the pixel row P1; in the unit period T9, the light sources in the light source row ROW_3 are driven according to respective summed driving current corresponding to bits B[4] and B[5] of pixel data of the pixel row P1; and in the unit period T13, the light sources in the light source row ROW_4 are driven according to respective summed driving current corresponding to bits B[6] and B[7] of pixel data of the pixel row P1. After 13 cycles, the driving circuit 410 may drive the light sources to display the 8-bit display data (e.g., B[0] through B[7]) on the pixel row P1 of the display medium. The luminance of a pixel $P_{1,j}$ in the pixel row P1 on the display medium may be positively related to a result of summing driving currents, which may be calculated according to equation (3):

$$\begin{aligned} I_{P1,j}=&\{I1*P_{1,j}_B[0]+I2*P_{1,j}_B[1]\}+\{I3*P_{1,j}_B[2]+\\ &I4*P_{1,j}_B[3]\}+\{I5*P_{1,j}_B[4]+I6*P_{1,j}_B[5]\}+\\ &\{I7*P_{1,j}_B[6]+I8*P_{1,j}_B[7]\}=1*I*P_{1,j}_B[0]+\\ &2*I*P_{1,j}_B[1]+4*I*P_{1,j}_B[2]+8*I*P_{1,j}_B[3]+\\ &16*I*P_{1,j}_B[4]+32*I*P_{1,j}_B[5]+64*I*P_{1,j}_B[6]+\\ &128*I*P_{1,j}_B[7] \end{aligned} \tag{3}$$

Figure 5A:
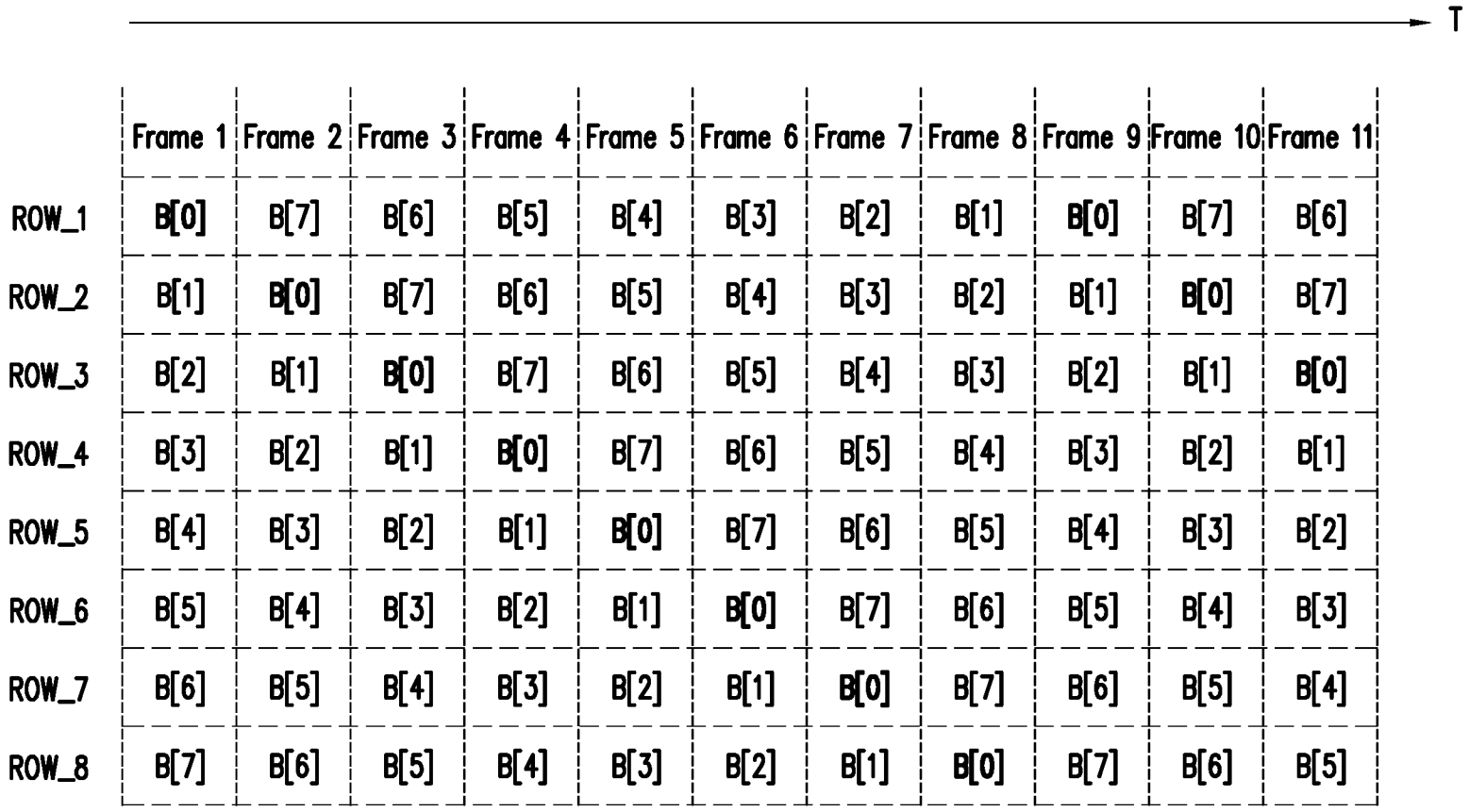
FIGS. 5A-5B are timing diagrams illustrating a scrolling function of a driving circuit in accordance with some embodiments.

FIG. 5A is a timing diagram illustrating a scrolling function of the driving circuit (e.g., the driving circuit 210 in FIG. 2A, the driving circuit 310 in FIG. 3A) in accordance with some embodiments. As the variations occurred during the manufacturing process of the light sources and the electrical connections among the light sources, the display quality of the light sources is inconsistent over the light sources of the display system. For example, different light sources may generate different illuminance value even being driven by the same driving current. The driving circuit may use the scrolling function to driving the light sources to improve the display quality for the display system.

Referring to FIG. 2A and FIG. 5A, the latch circuits L11 through L81 may respectively store bit values B[0] through B[7] of the pixel data of a pixel for driving the light sources LED_11 through LED_81. The light sources LED_11 through LED_81 is driven according to the bit values stored in the latch circuits L11 through L81. For example, the light source LED_11 is driven according to the bit values stored in the latch circuit L11; and the light source LED_81 is driven according to the bit values stored in the latch circuits L81.

In some embodiments, the driving circuit 210 may scroll the bit values stored in latch circuits L11 through L81 and change the current values of the current sources I1 through I8 to enable a scrolling function. Referring to FIG. 2A and FIG. 5A, the latch circuits L11 to L1M of the sub-driving circuit 210_1 that drives the light source row ROW_1 may store a plurality of bits B[0] of pixel data in the display frame 1. The reference current I1 a may be configured according to the bit order of the bit value B[0], such as 1*I. As such, the light source row ROW_1 may be driven to display the bits B[0] of pixel data in the display frame 1.

In the display frame 2, the latch circuits L11 to L1M of the sub-driving circuit 210_1 corresponding to the light source row ROW_1 may store a plurality of bits B[7] of pixel data in the display frame 1; and the reference current I1 may be configured according to the bit order of the bit value B[7], such as 128*I. As such, the light source row ROW_1 may be driven to display the bits B[7] of pixel data in the display frame 2. Similarly, the sub-driving circuits 210_2 to 210_8 may drive the light sources of the row ROW_2 through ROW_8 according to the different bit values in different display frames. As such, the influence or error due to device mismatch can be averaged. In this way, the display quality degradation caused by inconsistent quality of the light sources and the electrical connections thereof are reduced.

Figure 5B:
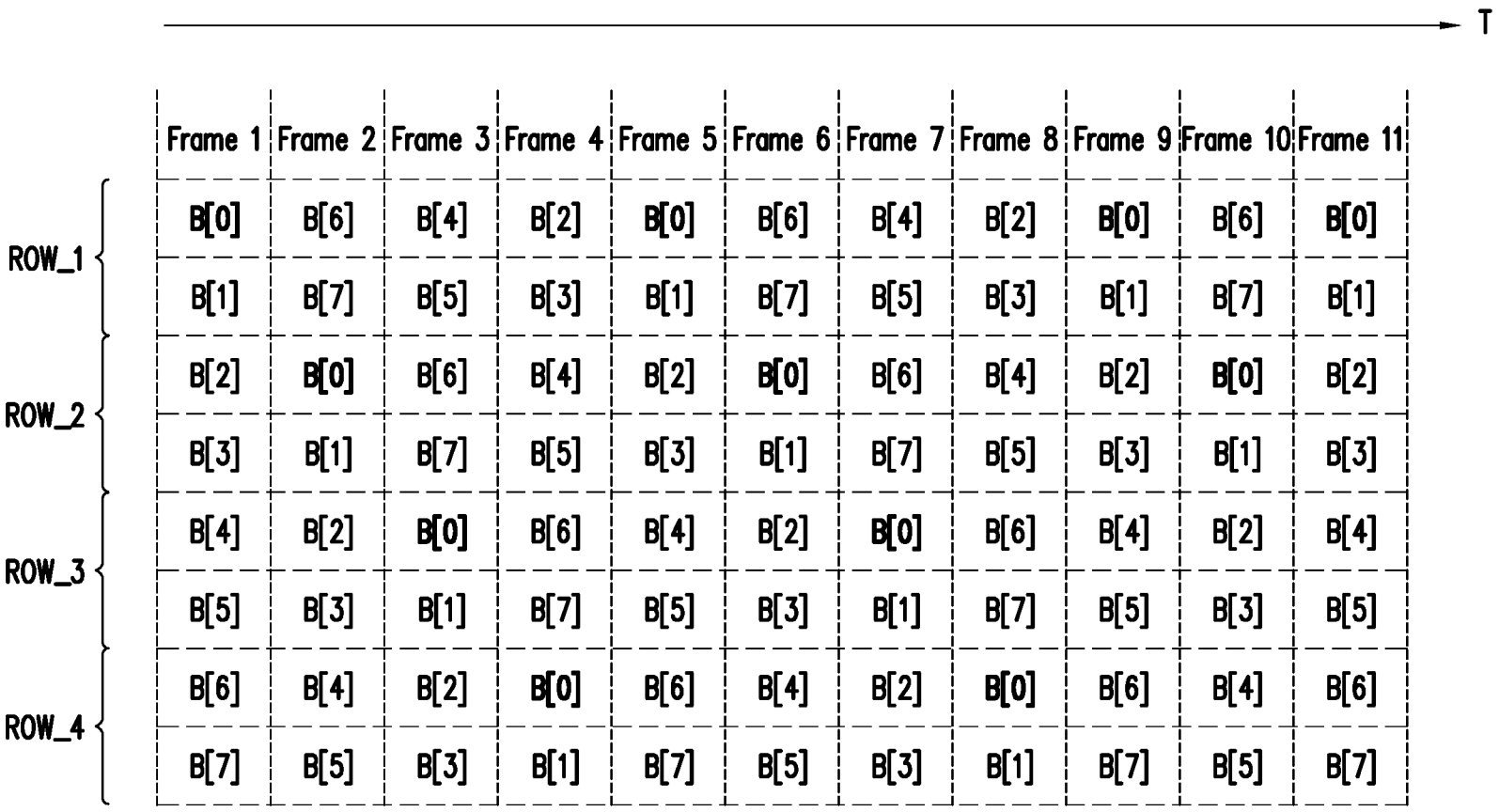

FIG. 5B is a timing diagram illustrating a scrolling function of the driving circuit (e.g., the driving circuit 410 in FIG. 4A) in accordance with some embodiments. Referring to FIG. 4A and FIG. 5B, the latch circuits L11 through L81 may respectively store bit values B[0] through B[7] of the pixel data of a pixel for driving the light sources LED_11 through LED_41. The light sources LED_11 through LED_41 are driven according to the bit values stored in the latch circuits of two sub-driving circuits. For example, the light source LED_11 is driven according to the bit values stored in the latch circuits L11 and L21; and the light source LED_41 is driven according to the bit values stored in the latch circuits L71 and L81.

In some embodiments, the driving circuit 410 may scroll the bit values stored in latch circuits and change the current values of the current sources I1 through I8 to enable a scrolling function. Referring to FIG. 4A and FIG. 5B, the latch circuits L11 through L1M may store the bit values B[0] of pixel data in the frame 1 and the latch circuits L21 through L2M may store the bit values B[1] of pixel data in the frame 1, for driving the light source row ROW_1. The reference currents I1 and I2 may be configured according to the bit order of the bit values B[0] and B[1], respectively. As such, the driving circuit 410 may drive the LED_11 through LED 1M according to the bit values B[0] and B[1] of pixel data in the display frame 1.

In the display frame 2, the latch circuits L11 through L1M may store the bit values B[6] of pixel data in the frame 2 and the latch circuits L21 through L2M may store the bit values B[7] of pixel data in the frame 2, for driving the light source row ROW_1; and the reference currents I1 and I2 may be configured according to the bit order of the bit values B[6] and B[7], respectively. As such, the driving circuit 410 may drive the light sources LED_11 through LED_1M of the light source row ROW_1 according to the bit values B[6] and B[7] of pixel data in the display frame 2. Similarly, the driving circuit 410 may drive each of the light source rows ROW_2 through ROW_4 according to the two different bit values of pixel data in every display frames. As such, the influence or error due to device mismatch can be averaged. In this way, the display quality degradation caused by inconsistent quality of the light sources and the electrical connections thereof are reduced.

Figure 6A:
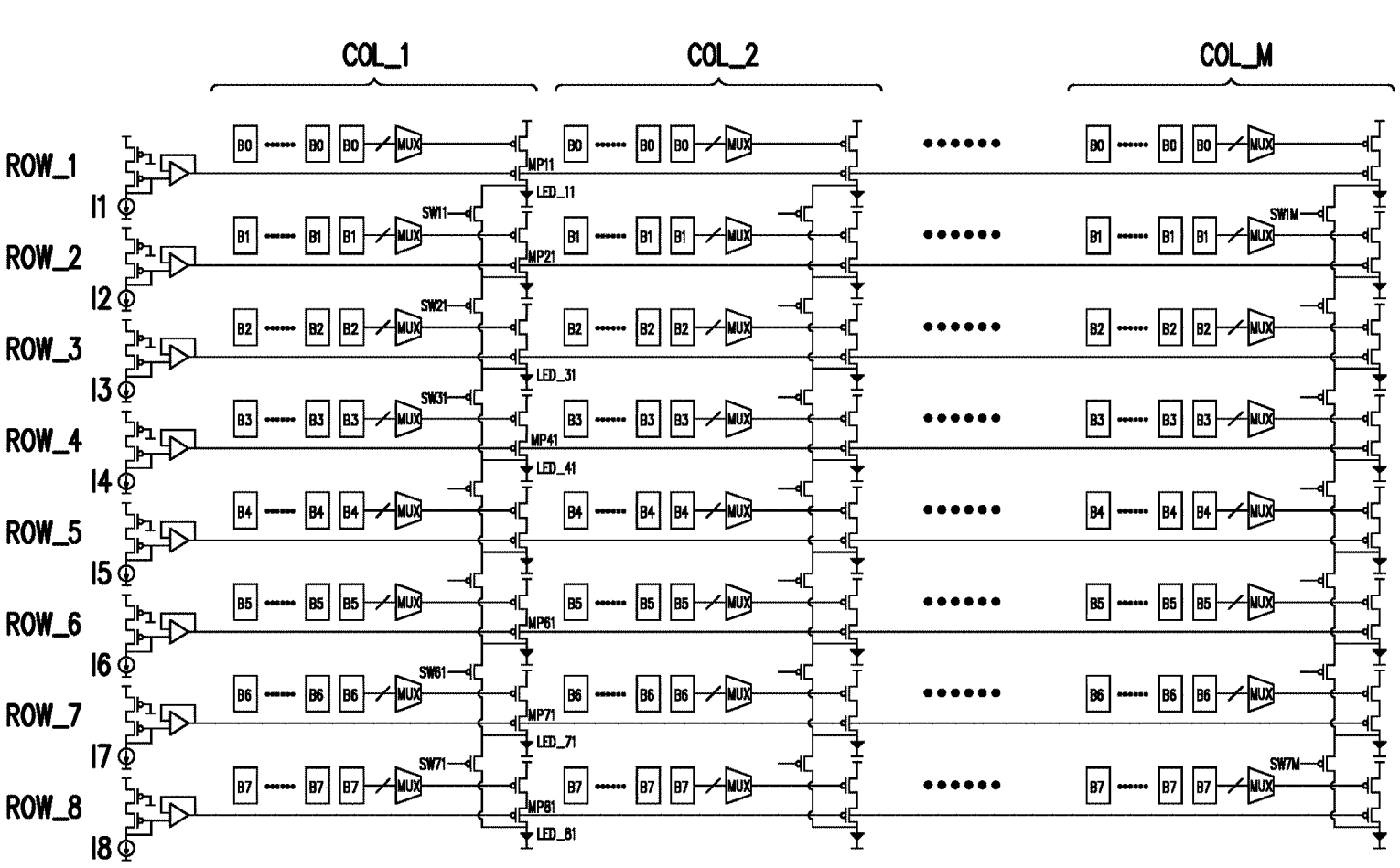
FIG. 6A is a schematic diagram of a driving circuit that is capable of compensating defect light sources in accordance with some embodiments.

FIG. 6A a schematic diagram of a driving circuit 610 that is capable of compensating emitting light for defect light sources in accordance with some embodiments. A difference between the driving circuit 610 shown in FIG. 6A and the driving circuit 210 shown in FIG. 2A is that the driving circuit 610 further include a current summation circuit that include a plurality of switches SW11 through SW7M. Each of the switches SW11 through SW71 of the current summation circuit is coupled between the output terminal of an output current mirror transistor of one sub-driving circuit that drives a light source row ROW_i and the output terminal of an output current mirror transistor of another one sub-driving circuit that drives a next light source row ROW_(i+1). For example, the switch SW11 is coupled between the output current mirror transistor MP11 and the output current mirror transistor MP21; and the switch SW71 is coupled between the output current mirror transistor MP71 and the output current mirror transistor MP81. The switches SW11 through SW7M of the current summation circuit may be controlled by a controller (e.g., the controller 140 in FIG. 1).

When there is a defect light source, e.g., light source LED_71, the driving circuit 610 may disable the defect light source LED_71 (i.e. not to output a driving current to the defect light source). In addition, the switches SW71 of the current summation circuit is turned on to electrically couple the output terminal of the output current mirror MP71 to the output terminal of the output current mirror MP81, such that the driving current for the detect light source LED_71 may be added into the driving current for the light source LED_81, while the switches SW11 to SW61 may be at an off state. As such, the light source LED_81 may replace the function of the defect light source LED_71, which means that the light source LED_81 does not only emit light corresponding to bit B[7] of pixel data but also emit light corresponding to bit B[6] of pixel data.

FIG. 6B is a timing diagram illustrating driving of the driving circuit 610 when light sources (e.g., LED_31 and LED_71) are defect light sources. The ratio of the light source to pixel pitch is 2:1 in the example of FIG. 6B. Referring to FIG. 6A and FIG. 6B, when the light source LED_31 in the light source row ROW_3 is a defect light source, the drive circuit 610 disables the light source LED_31 and control the switch 31 to be turned on to add the driving current for the light source LED_31 into the driving current for the light source LED_41 in the light source row ROW_4. In such a way, the light source LED_41 is driven in the unit period T7 by a summed driving current which is the summation of the driving current corresponding to bit B[2] of pixel data and the driving current corresponding to bit B[3] of pixel data. Similarly, when the light source LED_71 in row ROW_7 is a defect light source, the drive circuit 610 disables the light source LED_71 and control the switch 71 to be turned on to add the driving current for the light source LED_71 into the driving current for the light source LED_81 in the light source row ROW_8. In such a way, the light source LED_81 is driven in the unit period T14 by a summed driving current which is the summation of the driving current corresponding to bit B[6] of pixel data and the driving current corresponding to bit B[7] of pixel data. By controlling the switches SW11 through SWIM of the current summation circuit, the driving circuit 610 may adjust the driving current of a light source substitute in the next light source row to compensate the emitting light for the defect light sources.

Figure 7A:
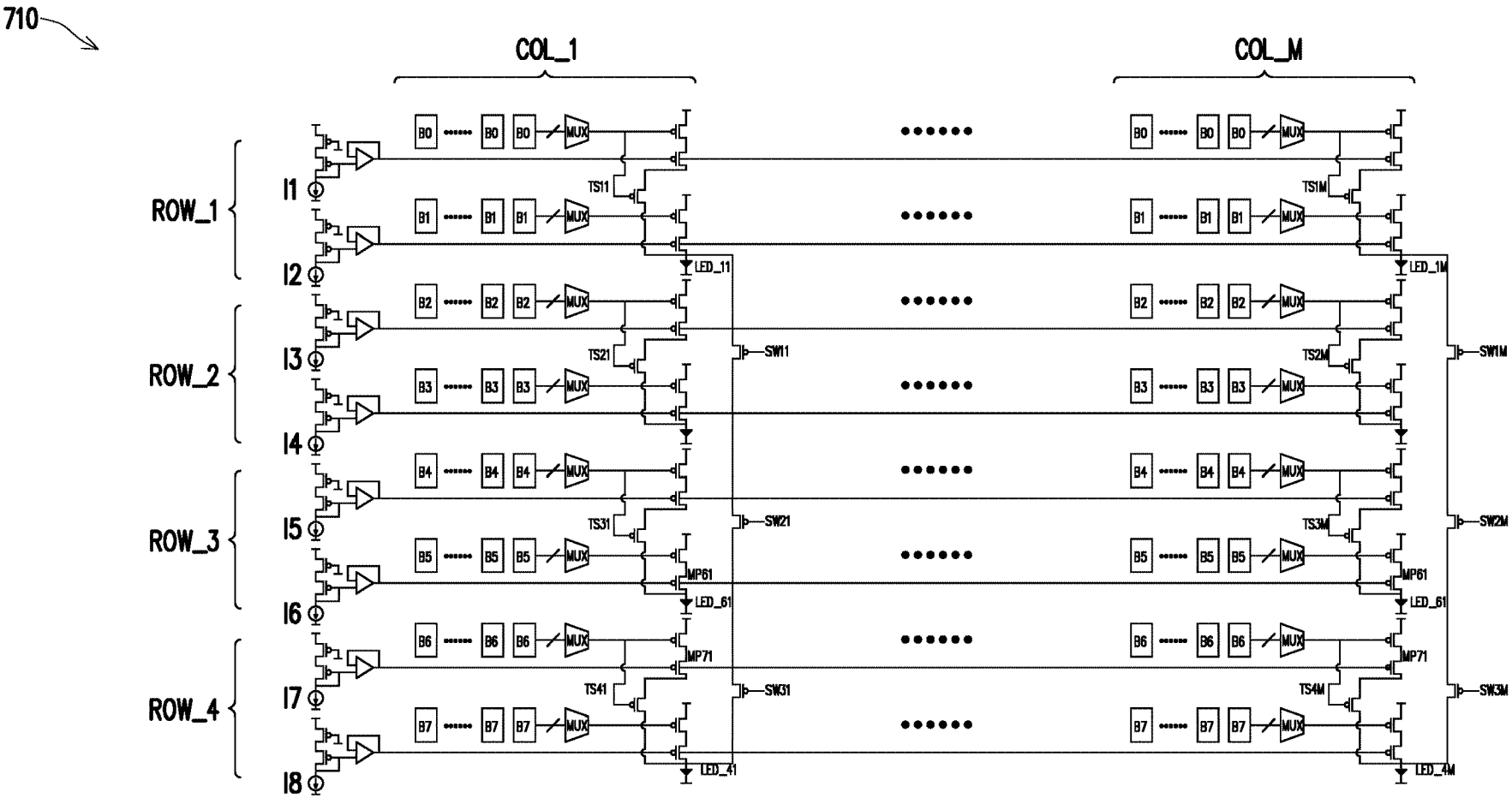
FIG. 7A is a schematic diagram of a driving circuit that is capable of compensating defect light sources in accordance with some embodiments.

FIG. 7A illustrates a driving circuit 710 that is capable of compensating emitting light for a defect light source in accordance with some embodiments. The driving circuit 710 may include a current transferring circuit including a plurality of switches TS11 through TS4M and may be used for driving four light source rows including light sources LED_11 through LED_4M, which are similar to the driving circuit 410 in FIG. 4A. A difference between the driving circuit 710 in FIG. 7A and the driving circuit 410 in FIG. 4A is that the driving circuit 710 further includes a current summation circuit that includes a plurality of switches SW11 through SW3M for the light source compensation function and has a similar circuitry as the current summation circuit in the driving circuit 610 in FIG. 6A. Each of the switches SW11 through SW3M of the current summation circuit is coupled between the output terminal of an output current mirror transistor of one sub-driving circuit that drives a light source row ROW_i and the output terminal of an output current mirror transistor of another one sub-driving circuit that drives a next light source row ROW_(i+1). The switches SW11 through SW3M of the current summation circuit may be controlled by a controller (e.g., the controller 140 in FIG. 1).

When there is a defect light source, e.g., light source LED_31 in light source row ROW_3, the driving circuit 610 may disable the light source LED_31 and control the switch SW31 to be turned on to electrically couple the output terminal of the output current mirror transistor MP61 to the output terminal of the output current mirror transistor MP81. As such, the driving current for the light source LED_41 in the next light source row (e.g., ROW_4) are adjusted to compensate the emitting light for the defect light sources.

Figure 7B:
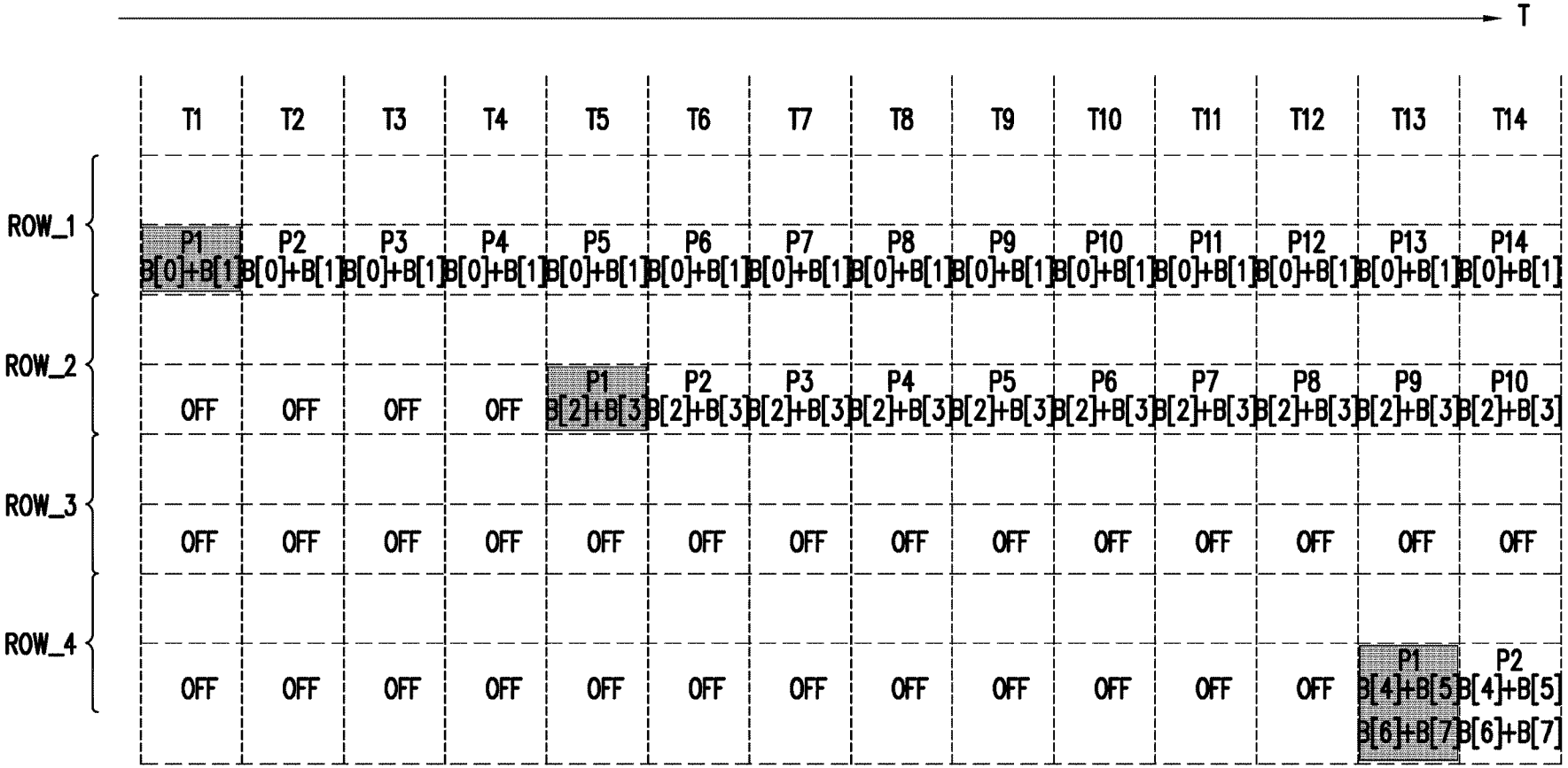
FIG. 7B is a timing diagram illustrating driving operations of a driving circuit for compensating defect light sources in accordance with some embodiments

FIG. 7B is a timing diagram illustrating driving of the driving circuit 710 when the light source LED_31 is a defect light source. Referring to FIG. 7A and FIG. 7B, when the light source LED_31 in the light source row ROW_3 is defected, the drive circuit 710 disables the light source LED_31, and control the switch 31 to be turned on to add the driving current for the light source LED_31 into the driving current for the light source LED_41 in the light source row ROW_4. In such a way, the light source LED_41 is driven in the unit period T13 by a summed driving current which is the summation of a plurality of the driving currents corresponding to bits B[4], B[5], B[6] and B[7] of pixel data. By controlling the switches SW11 through SW3M of the current summation circuit, the driving circuit 710 may adjust the driving current of a light source substitute in the next light source row to compensate the emitting light for the defect light sources.

Figure 8:
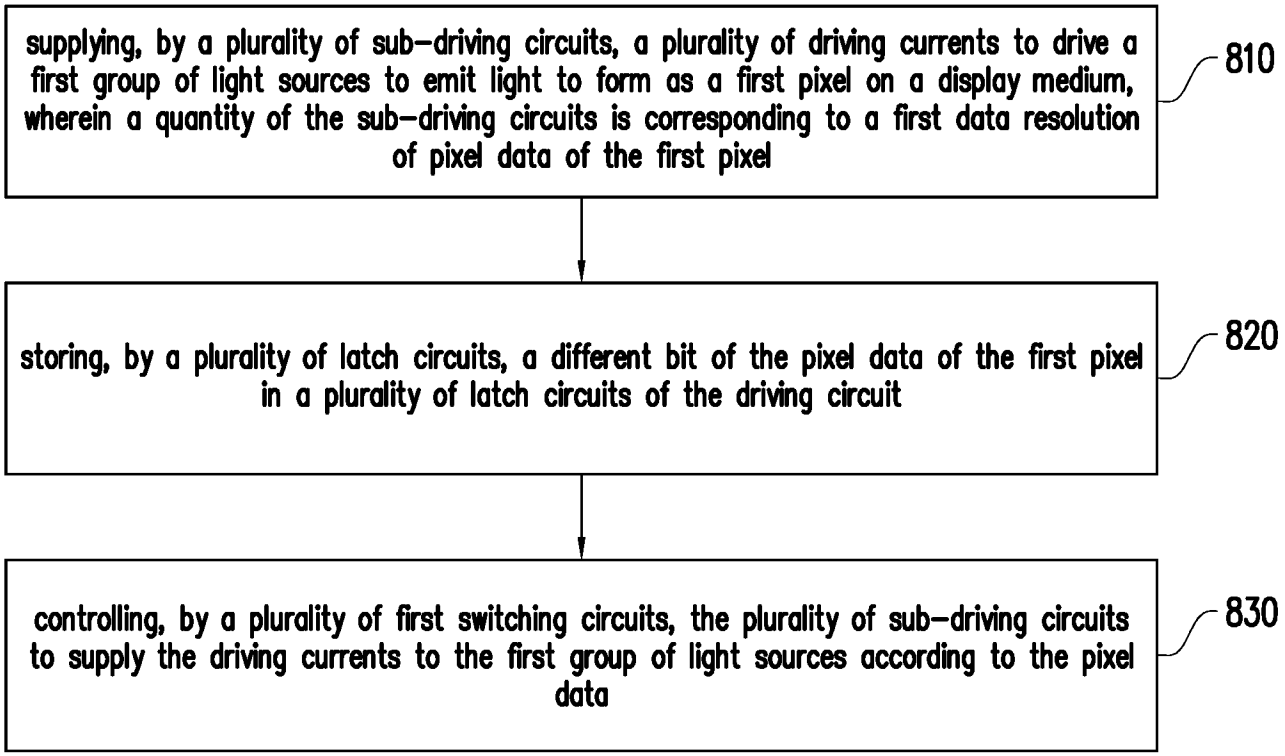
FIG. 8 is a flowchart diagram illustrating a driving method adapted to a driving circuit in accordance with some embodiments.

FIG. 8 illustrates a flowchart diagram of a driving method adapted to a driving circuit in accordance with some embodiments. In step S810, a plurality of driving currents is supplied, by a plurality of sub-driving circuits, to drive a first group of light sources to emit light to form a first pixel on a display medium, wherein a quantity of the sub-driving circuits is corresponding to a first data resolution of pixel data of the first pixel. In step S820, a different bit of the pixel data of the first pixel is stored, by a plurality of latch circuits, in a plurality of latch circuits of the driving circuit In step S830, the plurality of sub-driving circuits is controlled, by a plurality of first switching circuits, to supply the driving currents to the first group of light sources according to the pixel data.

From the embodiments of the disclosure, a plurality of sub-driving circuits of a driving circuit are employed to drive a group of light sources to form a pixel on a display medium according to pixel data with a specific resolution. The sub-driving circuits may use different reference currents or voltages to achieve the specific resolution of the pixel data. In the embodiments of the disclosure, the light sources are not driven based on the duty cycle of a pulse width modulation but driven in a time-divisional manner, and in every unit period of the cycle completely displaying a pixel, the driving currents for different bits of pixel data are supplied to the corresponding light sources for the same time length (within the unit period) no matter what the gray level the pixel data is, such that the degradation of display quality under high refresh rate is prevented. In addition, additional sub-driving circuits and the current summation circuit may be configured to allow the driving circuit to drive the light sources according a higher resolution (e.g., 10-bit pixel data). The switches included in the current summation circuit may also allow the drive circuits to drive the light sources according to different resolutions, thereby improving the flexibility of the driving circuit. The driving circuit may have a scrolling function to reduce the negative effects caused by the imperfect manufacturing of the light sources. Furthermore, the repairing mechanism may also be implemented in driving circuit using the current summation circuit to turn off the defect light sources and compensate the emitting light for the defect light sources using the light sources in next-row.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A light source driving circuit, comprising:

a plurality of sub-driving circuits, configured to supply a plurality of driving currents to drive a first group of light sources to emit light to form a first pixel on a display medium; and a plurality of first switching circuits, respectively coupled to the plurality of sub-driving circuits and configured to control the plurality of sub-driving circuits to supply the driving currents to the first group of light sources according to pixel data, wherein a current value of each of the plurality of driving currents is corresponding to a bit order of a respective bit of the pixel data.

2. The light source driving circuit of claim 1, further comprising:

a plurality of latch circuits, wherein each of the latch circuits is configured to store a different bit of the pixel data of the first pixel, wherein each of the latch circuits is configured to store at least two bit values of a same bit position with respect to at least two pixels on the display medium.

3. The light source driving circuit of claim 2, further comprising:

a plurality of multiplexers, wherein each of the multiplexers is coupled to one of the latch circuits and one of the first switching circuits and is configured to time-divisionally output the at least two bit values stored in the one of the latch circuits to control the one of the first switching circuits.

4. The light source driving circuit of claim 2, wherein each of the sub-driving circuits comprises:

a bias current generating circuit, configured to generate a reference current, wherein a value of the reference current is configured according to the bit order of the pixel data; and a current mirror circuit, configured to generate a plurality of output currents to respectively drive a second group of light sources, wherein one of the output currents is a first driving current of the driving currents that is to drive a light source of the first group of light sources.

5. The light source driving circuit of claim 4, further comprising:

at least one additional sub-driving circuit, configured to supply at least one additional driving current; and a current summation circuit, coupled to the at least one additional sub-driving circuit and at least one light source of the first group of light sources, configured to transmit the at least one additional driving current to the at least one light source, wherein a quantity of the sub-driving circuits is corresponding to a first data resolution of pixel data of the first pixel, and a total quantity of the sub-driving circuits and the at least one additional sub-driving circuits is corresponding to a second data resolution that is greater than the first data resolution.

6. The light source driving circuit of claim 5, wherein the current summation circuit comprises:

at least one first switch, coupled between the at least one additional sub-driving circuit and the at least one light source of the first group of light sources, configured to transmit the at least one additional driving currents to the at least one light source.

7. The light source driving circuit of claim 6, further comprising:

a controller, coupled to the at least one first switch, and configured to generate a control signal to control switching operation of the at least one first switch.

8. The light source driving circuit of claim 4, wherein the bias current generating circuit in each of the sub-driving circuits corresponds to one of the latch circuits, the bias current generating circuit is configured to generate a first reference current which is applied in a first display frame and the corresponding one of the latch circuits is configured to store a bit value of a first bit position of the pixel data in the first display frame; and the bias current generating circuit is configured to generate a second reference current which is applied in a second display frame and the corresponding one of the latch circuits is configured to store a bit value of a second bit position of the pixel data in the second display frame.

9. The light source driving circuit of claim 2, further comprising:

a current transferring circuit, coupled to a first number of the plurality of latch circuits and coupled to a first number of the plurality of sub-driving circuits and configured to transfer a first number of driving currents among the driving currents output from the corresponding first number of sub-driving circuits to the first group of light sources.

10. The light source driving circuit of claim 9, wherein the current transferring circuit comprises a plurality of switches which are controlled according to some of bits of the pixel data stored in corresponding latch circuits.

11. The light source driving circuit of claim 1, wherein the sub-driving circuits drives the first group of light sources in a time-divisional manner to emit lights so as to form the first pixel on the display medium by visual persistence.

12. A driving method adapted for a driving circuit comprising a plurality of sub-driving circuits, and a plurality of first switching circuits, the driving method comprising:

supplying, by the plurality of sub-driving circuits, a plurality of driving currents to drive a first group of light sources to emit light to form a first pixel on a display medium;

controlling, by the plurality of first switching circuits, the plurality of sub-driving circuits to supply the driving currents to the first group of light sources according to pixel data, wherein a current value of each of the plurality of driving currents is corresponding to a bit order of a respective bit of the pixel data.

13. The method of claim 12, further comprising:

storing, by each of the plurality of latch circuits, a different bit of the pixel data of the first pixel in a plurality of latch circuits of the driving circuit, wherein storing the different bit of the pixel data of the first pixel in the plurality of latch circuits of the driving circuit comprises:

storing at least two bit values of a same bit position with respect to at least two pixels on the display medium.

14. The method of claim 13, further comprising:

outputting, by a plurality of multiplexers of the driving circuit, the at least two bit values stored in the latch circuits to control the one of the first switching circuits.

15. The method of claim 13, further comprising:

generating a reference current according to the bit order of pixel data; and generating a plurality of output currents to respectively drive a second group of light sources, wherein one of the output currents is a first driving current of the driving currents that is to drive a light source of the first group of light sources.

16. The method of claim 13, further comprising:

transferring, by a current transferring circuit of the driving circuit, a first number of driving currents among the driving currents output from the corresponding first part of sub-driving circuits to the first group of light sources, wherein the current transferring circuit is coupled to a first part of the plurality of latch circuits and coupled to a first part of the plurality of sub-driving circuits.

17. The method of claim 16, further comprising:

controlling a plurality of switches of the current transferring circuit according to some of bits of the pixel data store in corresponding latch circuits.

18. The method of claim 13, further comprising:

scrolling a bit position of the pixel data stored in each of the latch circuits and scrolling a reference current generated by the bias circuit of each of the sub-driving circuits in each display frame, wherein a first reference current is generated by the bias current generating circuit and is applied in a first display frame and a bit value of a first bit position of the pixel data is stored in the corresponding one of the latch circuits in the first frame, and a second reference current is generated by the bias current generating circuit and is applied in a second display frame and a bit value of a second bit position of the pixel data is stored by the corresponding one of the latch circuits in the second display frame.

19. The method of claim of claim 12, further comprising:

supplying, by at least one additional sub-driving circuit of the driving circuit, at least one additional driving current; and transmitting, by a current summation circuit of the driving circuit, the at least one additional driving currents to at least one light source, wherein a quantity of the sub-driving circuits is corresponding to a first data resolution of pixel data of the first pixel, and a total quantity of the sub-driving circuits and the at least one additional sub-driving circuits is corresponding to a second data resolution that is greater than the first data resolution.

* * * * *